US007553797B2

(12) United States Patent
Ono et al.

(10) Patent No.: US 7,553,797 B2
(45) Date of Patent: Jun. 30, 2009

(54) THERMAL TRANSFER RECORDING MATERIAL AND THERMAL TRANSFER RECORDING METHOD

(75) Inventors: Kaori Ono, Hachioji (JP); Takatugu Suzuki, Hachioji (JP); Kazuya Yoshida, Tokyo (JP); Hiroyuki Yamashita, Tokyo (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 285 days.

(21) Appl. No.: 11/172,712

(22) Filed: Jul. 1, 2005

(65) Prior Publication Data

US 2005/0250645 A1 Nov. 10, 2005

(30) Foreign Application Priority Data

Jul. 5, 2004 (JP) ..... 2004-197518

(51) Int. Cl.
*B41M 5/035* (2006.01)
*B41M 5/50* (2006.01)

(52) U.S. Cl. ..... 503/227; 8/471; 428/32.6

(58) Field of Classification Search ..... None
See application file for complete search history.

(56) References Cited

U.S. PATENT DOCUMENTS 4,757,046 A 7/1988 Byers et al.

FOREIGN PATENT DOCUMENTS

EP 0 257 577 A2 3/1988
EP 0 763 569 A1 3/1997

*Primary Examiner*—Bruce H Hess
(74) *Attorney, Agent, or Firm*—Lucas & Mercanti, LLP

(57) ABSTRACT

A thermal transfer recording material contains at least one colorant represented by the following general formula (I):

General formula (I)

wherein $R_1$ represents a trifluoromethyl, alkyl, aryl, alkoxy, alkoxycarbonyl, acyl, acyloxy, amide, carbamoyl, amino, or cyano group; $R_2$ represents alkyl, acyl, carbamoyl, or alkoxycarbonyl group; $R_3$ represents alkyl, alkenyl or aryl group; a total number of carbon atoms in $R_1$ and $R_2$ is 3 or more; X represents —$CR_4R_5$—, —S—, —O— or —$NR_6$—; $R_4$ and $R_5$ respectively represent hydrogen, halogen, or a substituent; $R_6$ represents hydrogen or a substituent; and Y represents an atom group required for forming a 5- to 6-memberd ring.

1 Claim, No Drawings

THERMAL TRANSFER RECORDING MATERIAL AND THERMAL TRANSFER RECORDING METHOD

BACKGROUND OF THE INVENTION

1. Field of the Invention

The present invention relates to a thermal transfer recording material and a thermal transfer recording method containing a specific colorant.

2. Description of Related Art

A thermal transfer recording has advantages such as easy operation and maintenance, downsized apparatus, potential reduction in cost and inexpensive running cost. For the purpose of improving stability, particularly fixable property and light resistance of an image obtained by the thermal transfer recording, thermal transfer recording materials and methods for the image formation using thermally diffusible colorants (referred to as chelate colorants) capable of being chelated have been proposed, and described in JP SHO 59-78893A, JP SHO 59-10349A and JP SHO 60-2398A. The chelate colorants disclosed therein are metal chelate colorants formed by bidentate or tridentate coordination of an azo colorant as a ligand to metal ion. An image formed using these chelate colorants is excellent in light resistance and fixable property, but is not sufficiently satisfied in sensitivity and color tone of the thermal transfer recording material, and further improvement has been desired.

Many pyrazolone colorants have been synthesized, their usefulness has been identified, and they have been widely used. Recently, they have been frequently applied to various uses such as photographic photosensitive materials, thermal transfer recording materials, color toner, optical recording media and color filters.

In most pyrazolone colorants in earlier development, a phenyl group is substituted on a nitrogen atom at position 1 of pyrazolone (see U.S. Pat. Nos. 2,265,908, 2,369,355, 2,398,999, 2,409,189, 2,430,558 and 2,519,001). In U.S. Pat. No. 4,757,046, a compound where a methyl group is substituted on the nitrogen atom at position 1 of pyrazolone has been described. However, such pyrazolone colorants have poor solubility in a solvent and low sensitivity, and are inferior in light resistance when used as the thermal transfer recording material.

SUMMARY OF THE INVENTION

The present invention has been made in the light of the above circumstance, and one of objects of the invention is to provide a thermal transfer recording material and a thermal transfer recording method containing a novel colorant which has preferable hue in color reproducibility, is excellent in light resistance and is highly sensitive.

According to a first aspect of the present invention, the thermal transfer recording material comprises at least one colorant represented by the following general formula (I):

General formula (I)

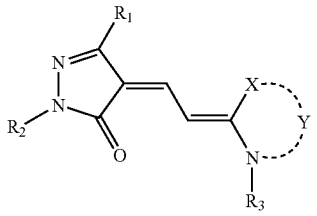

(In the general formula (I), $R_1$ represents a trifluoromethyl, alkyl, aryl, alkoxy, alkoxycarbonyl, acyl, acyloxy, amide, carbamoyl, amino, or cyano group, $R_2$ represents an alkyl, acyl, carbamoyl, or alkoxycarbonyl group, and $R_3$ represents an alkyl, alkenyl or aryl group. But, a total number of carbon atoms in $R_1$ and $R_2$ is 3 or more. X represents —$CR_4R_5$—, —S—, —O— or —$NR_6$—, $R_4$ and $R_5$ represent hydrogen, halogen atoms, or substituents, and $R_6$ represents a hydrogen atom or a substituent. Y represents an atom group required for forming a 5- to 6-memberd ring.)

Preferably, $R_2$ in the above general formula (I) is an alkyl group.

Preferably, $R_1$ in the above general formula (I) is an alkyl group.

Preferably, $R_1$ in the above general formula (I) is a branched alkyl group.

Preferably, X in the above general formula (I) is —O—.

Preferably, the colorant represented by the general formula (I) is a colorant represented by the following general formula (II):

General formula (II)

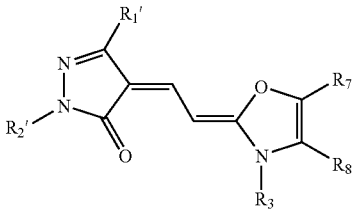

wherein $R_1'$ represents an alkyl group; $R_2'$ represents an alkyl, acyl or carbamoyl group; $R_3$ represents an alkyl, alkenyl or aryl group; a total number of carbon atoms in $R_1'$ and $R_2'$ is 3 or more; $R_7$ and $R_8$ respectively represent hydrogen, halogen, or a substituent; $R_7$ and $R_8$ comprise a ring which is formed by binding $R_7$ and $R_8$ substituted one another.

Preferably, the colorant represented by the general formula (I) is a colorant represented by the following general formula (III):

General formula (III)

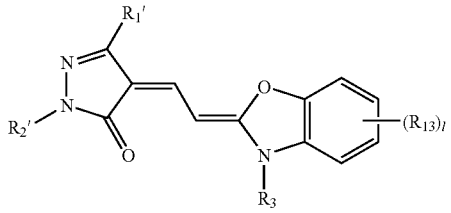

wherein $R_1'$ represents an alkyl group; $R_2'$ represents an alkyl, acyl or carbamoyl group; $R_3$ represents an alkyl, alkenyl or aryl group; a total number of carbon atoms in $R_1'$ and $R_2'$ is 3 or more; $R_{13}$ represents halogen or a substituent; and 1 represents an integer of 0 to 4.

Preferably, X in the general formula (I) is —$CR_4R_5$—.

Preferably, the colorant represented by the general formula (I) is a colorant represented by the following general formula (IV):

General formula (IV)

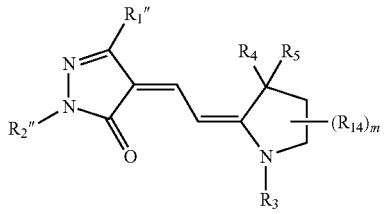

wherein $R_1''$ represents a trifluoromethyl, alkoxycarbonyl, acyl, carbamoyl, or cyano group; $R_2''$ represents an alkyl, acyl or carbamoyl group; $R_3$ represents an alkyl, alkenyl or aryl group; a total number of carbon atoms in $R_1''$ and $R_2''$ is 3 or more; $R_4$ and $R_5$ respectively represent hydrogen, halogen, or a substituent; $R_{14}$ represents hydrogen atom or a substituent; m represents an integer of 0 to 4; $R_4$, $R_5$ and $(R_{14})_m$ comprise a ring which is formed by binding $R_4$, $R_5$ and $R_{14}$ substituted on adjacent carbon atoms one another.

Preferably, X in the general formula (I) is —S—.

Preferably, the colorant represented by the general formula (I) is a colorant represented by the following general formula (V):

General formula (V)

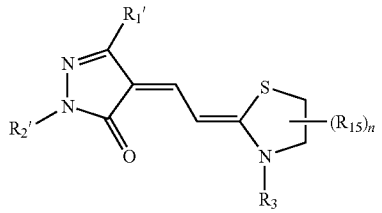

wherein $R_1'$ represents an alkyl group; $R_2'$ represents an alkyl, acyl or carbamoyl group; $R_3$ represents an alkyl, alkenyl or aryl group; a total number of carbon atoms in $R_1'$ and $R_2'$ is 3 or more; $R_{15}$ represents hydrogen or a substituent; n represents an integer of 0 to 4; $(R_{15})_n$ comprises a ring which is formed by binding $R_{15}$ substituted on adjacent carbon atoms one another.

According to a second aspect of the invention, a thermal transfer recording method to form an image on an image receiving material, comprises: lapping the image receiving material over a thermal transfer recording material which comprises a colorant providind layer containing at least one colorant represented by the following general formula (I) on a support; and heating the thermal transfer recording material in accordance with image information, General formula (I)

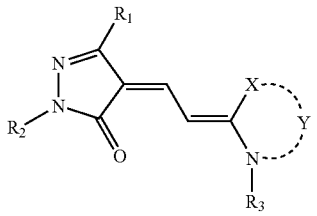

wherein $R_1$ represents a trifluoromethyl, alkyl, aryl, alkoxy, alkoxycarbonyl, acyl, acyloxy, amide, carbamoyl, amino, or cyano group; $R_2$ represents alkyl, acyl, carbamoyl, or alkoxycarbonyl group; $R_3$ represents alkyl, alkenyl or aryl group; a total number of carbon atoms in $R_1$ and $R_2$ is 3 or more; X represents $—CR_4R_5—$, —S—, —O— or $—NR_6—$; $R_4$ and $R_5$ respectively represent hydrogen, halogen, or a substituent; $R_6$ represents hydrogen or a substituent; and Y represents an atom group required for forming a 5- to 6-memberd ring.

Preferably, the image receiving material comprises a colorant image-receiving layer containing a metal ion-containing compound on a support, and the image is a metal chelate colorant image.

According to the present invention, it is possible to obtain the thermal transfer recording material containing a novel colorant which has preferable hue in color reproducibility, is excellent in light resistance and is highly sensitive. An image which has high sensitivity, preferable color reproducibility and preferable light resistance can be formed by the use of the thermal transfer recording material containing the novel colorant which has preferable hue in color reproducibility, is excellent in light resistance and is highly sensitive.

DETAILED DESCRIPTION OF PREFERRED EMBODIMENTS

Best modes for carrying out the invention will be illustrated below. However, the invention is not limited thereto.

First, the colorants according to the present invention will be described in detail.

In the general formula (I), $R_1$ represents a trifluoromethyl, alkyl, aryl, alkoxy, alkoxycarbonyl, acyl, acyloxy, amide, carbamoyl, amino, or cyano group.

The alkyl groups include, for example, methyl, ethyl, propyl, isopropyl, tert-butyl, pentyl, hexyl, octyl, dodecyl, tridecyl, tetradecyl, pentadecyl, and the like, the aryl groups include, for example, phenyl, naphthyl and the like, the alkoxy groups include methoxy, ethoxy, propyloxy, pentyloxy, hexyloxy octyloxy, dodecyloxy and the like, the alkoxycarbonyl groups include for example, methyloxycarbonyl, ethyloxycarbonyl, butyloxycarbonyl, octyloxycarbonyl, dodecyloxycarbonyl and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, the acyloxy groups include for example, acetyloxy, ethylcarbonyloxy, butylcarbonyloxy, octylcarbonyloxy, dodecylcarbonyloxy, phenylcarbonyloxy and the like, the amide groups include for example, methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino and the like, the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like, and the amino groups include for example, amino, ethylamino, dimethylamino, butylamino, cyclopentylamino, 2-ethylhexylamino, dodecylamino, anilino, naphthylamino, 2-pyridylamino and the like.

The alkyl, trifluoromethyl, alkoxycarbonyl, acyl carbamoyl and cyano groups are preferable, and the alkyl group is more preferable. Among the alkyl groups, a branched alkyl group is more preferable. The branched alkyl groups include for example isopropyl, tert-butyl, isobutyl, sec-butyl, neopentyl, tert-amyl and the like. Isopropyl and tert-butyl are the most preferable.

In the present invention, the light resistance of the colorant is enhanced by making $R_1$ bulky.

$R_2$ represents alkyl, acyl, carbamoyl, or alkoxycarbonyl group.

The alkyl groups include, for example, methyl, ethyl, propyl, isopropyl, tert-butyl, pentyl, hexyl, octyl, dodecyl, tridecyl, tetradecyl, pentadecyl, and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like, and the alkoxycarbonyl groups include for example, methyloxycarbonyl, ethyloxycarbonyl, butyloxycarbonyl, octyloxycarbonyl, dodecyloxycarbonyl and the like.

The alkyl, acyl and carbamoyl groups are preferable, and the alkyl group is more preferable. Among the alkyl groups, methyl, ethyl, propyl, isopropyl, butyl and tert-butyl are particularly preferable, and methyl is the most preferable.

When $R_2$ is the alkyl, alkoxycarbonyl, acyl or carbamoyl group as in the invention, the colorant is excellent in solvent solubility and gram $\epsilon$ also becomes high.

In the invention, the total number of the carbon atoms in $R_1$ and $R_2$ is 3 or more. That is, when the total number of the carbon atoms in $R_1$ and $R_2$ is 3 or more, the solvent solubility becomes better.

$R_3$ represents an alkyl, alkenyl or aryl group.

The alkyl groups include, for example, methyl, ethyl, propyl, isopropyl, tert-butyl, pentyl, hexyl, octyl, dodecyl, tridecyl, tetradecyl, pentadecyl, and the like, the alkenyl groups include for example, vinyl, allyl and the like, and the aryl groups include for example, phenyl, naphthyl and the like.

The alkyl group is preferable. Among the alkyl groups, methyl, ethyl, propyl, isopropyl, butyl, isobutyl, sec-butyl, tert-butyl, pentyl and neopentyl are preferable, and methyl, ethyl, propyl, isopropyl, and butyl are the most preferable.

X represents —$CR_4R_5$—, —S—, —O— or —$NR_6$—, and —$CR_4R_5$—, —S— and —O— are preferable.

$R_4$ and $R_5$ represent hydrogen, halogen atoms, or substituents.

The halogen atoms include fluorine, chlorine, bromine, iodine atoms and the like, and the fluorine and chlorine atoms are preferable. The substituents include alkyl groups (e.g., methyl, ethyl, propyl, isopropyl, tert-butyl, pentyl, hexyl, octyl, dodecyl, tridecyl, tetradecyl, pentadecyl, etc.), cycloalkyl groups (e.g., cyclopentyl, cyclohexyl, etc.), alkenyl groups (e.g., vinyl, allyl, etc.), alkynyl groups (e.g., ethynyl, propargyl, etc.), aryl groups (e.g., phenyl, naphthyl, etc.), heteroaryl groups (e.g., fulyl, thienyl, pyridyl, pyridazyl, pyrimidyl, pyrazyl, triazyl, imidazolyl, pyrazolyl, tiazolyl, benzimidazolyl, benzoxazolyl, quinazolyl, phthalazyl, etc.), heterocyclic groups (e.g., pyrolidyl, imidazolidyl, morpholyl, oxazolydyl, etc.), alkoxy groups (e.g., methoxy, ethoxy, propyloxy, pentyloxy, hexyloxy, octyloxy, dodecyloxy, etc.), cycloalkoxy groups (e.g., cyclopentyloxy, cyclohexyloxy, etc.), aryloxy groups (e.g., phenoxy, naphthyloxy, etc.), alkylthio groups (e.g., methylthio, ethylthio, propylthio, pentylthio, hexylthio, octylthio, dodecylthio, etc.), cycloalkylthio groups (e.g., cyclopentylthio, cyclohexylthio, etc.), arylthio groups (e.g., phenylthio, naphthylthio, etc.), alkoxycarbonyl groups (e.g., methyloxycarbonyl, ethyloxycarbonyl, butyloxycarbonyl, octyloxycarbonyl, dodecyloxycarbonyl, etc.), aryloxycarbonyl groups (e.g., phenyloxycarbonyl, naphthyloxycarbonyl, etc.), sulfamoyl groups (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecylaminosulfonyl, phenylaminosulfonyl, naphthylaminosulfonyl, 2-pyridylaminosulfonyl, etc.), acyl groups (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl, etc.), acyloxy groups (e.g., acetyloxy, ethylcarbonyloxy, butylcarbonyloxy, octylcarbonyloxy, dodecylcarbonyloxy, phenylcarbonyloxy, etc.), amide groups (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino, etc.), carbamoyl groups (e.g., aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl, etc.), ureido groups (e.g., methylureido, ethylureido, pentylureido, cyclohexylureido, octylureido, dodecylureido, phenylureido, naphthylureido, 2-pyridylaminoureido, etc.), sulfinyl groups (e.g., methylsulfinyl, ethylsulfinyl, butylsulfinyl, cyclohexylsulfinyl, 2-ethylhexylsulfinyl, dodecylsulfinyl, phenylsulfinyl, naphthylsulfinyl, 2-pyrizylsulfinyl, etc.), alkylsulfonyl groups (e.g., methylsulfonyl, ethylsulfonyl, butylsulfonyl, cyclohexylsulfonyl, 2-ethylhexylsulfonyl, dodecylsulfonyl, etc.), arylsulfonyl groups (e.g., phenylsulfonyl, naphthylsulfonyl, 2-pyrizylsulfonyl, etc.), amino groups (e.g., amino, ethylamino, dimethylamino, butylamino, cyclopentylamino, 2-ethylhexylamino, dodecylamino, anilino, naphthylamino, 2-pyridylamino, etc.), cyano group, nitro group, and the like.

The hydrogen atom, alkyl and aryl groups are preferable. More preferably, the hydrogen atom and the alkyl group are preferable. Among the alkyl groups, methyl, ethyl, propyl, isopropyl, butyl, isobutyl, sec-butyl, pentyl and neopentyl are preferable, and methyl is the most preferable.

$R_6$ represents a hydrogen atom or a substituent.

The substituent includes the same substituents included in the examples of the above $R_4$ and $R_5$.

The hydrogen atom, alkyl and aryl groups are preferable. More preferably, the hydrogen atom and the alkyl group are preferable. Among the alkyl groups, methyl, ethyl, propyl, isopropyl, butyl, isobutyl, sec-butyl, pentyl and neo-pentyl are preferable, and methyl is the most preferable.

Y represents an atom group required for forming a 5- to 6-memberd ring.

The atom group required for forming the 6-membered ring is preferable, and includes for example, —$CR_7$=$CR_8$— and $CR_9R_{10}$—$CR_{11}R_{12}$—. $R_7$ and $R_8$ or $R_9$ and $R_{11}$ may be bound one another to form a ring. $R_7$ to $R_{12}$ represent hydrogen atoms, halogen atoms or substituents.

The halogen atoms include fluorine, chlorine, bromine, iodine atoms and the like, and the fluorine and chlorine atoms are preferable.

The substituents include the same substituents included in the examples of the above $R_4$ and $R_5$. The alkyl and aryl groups are preferable, and the alkyl groups are more preferable. The hydrogen atom and methyl group are the most preferable. $R_7$ and $R_8$ or $R_9$ and $R_{11}$ may be bound one another to form a 5- to 6-membered ring. For example, a cyclopentane, cyclohexane, benzene, pyridine, naphthalene rings and the like are included, and the benzene ring is preferable.

Subsequently, the general formula (II) will be described.

In the general formula (II), $R_1'$ represents an alkyl group.

The alkyl group includes for example, methyl, ethyl, propyl, isopropyl, tert-butyl, pentyl, hexyl, octyl, dodecyl, tridecyl, tetradecyl, pentadecyl, and the like.

A branched alkyl group is preferable.

The branched alkyl group includes for example, isopropyl, tert-butyl, isobutyl, sec-butyl, neo-pentyl, tert-amyl and the like, and isopropyl and tert-butyl are the most preferable.

$R_2'$ represents an alkyl, acyl or carbamoyl group.

The alkyl groups include, for example, methyl, ethyl, propyl, isopropyl, tert-butyl, pentyl, hexyl, octyl, dodecyl, tridecyl, tetradecyl, pentadecyl, and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, and the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like.

The alkyl and acyl groups are preferable.

Among the alkyl groups, methyl, ethyl, propyl, isopropyl, butyl and tert-butyl are preferable, and methyl is the most preferable.

Among the acyl groups, acetyl, ethylcarbonyl, propylcarbonyl, butylcarbonyl and isobutylcarbonyl are preferable, and acetyl and isobutylcarbonyl are the most preferable.

In the invention, the total number of the carbon atoms in $R_1'$ and $R_2'$ is 3 or more. That is, when the total number of the carbon atoms in $R_1'$ and $R_2'$ is 3 or more, the solvent solubility becomes better.

$R_3$ represents an alkyl, alkenyl or aryl group.

The alkyl groups include, for example, methyl, ethyl, propyl, isopropyl, tert-butyl, pentyl, hexyl, octyl, dodecyl, tridecyl, tetradecyl, pentadecyl, and the like, the alkenyl groups include for example, vinyl, allyl and the like, and the aryl groups include for example, phenyl, naphthyl and the like.

The alkyl groups are preferable. Among the alkyl groups, methyl, ethyl, propyl, isopropyl, butyl, isobutyl, sec-butyl, pentyl and neopentyl are preferable, and methyl, ethyl, propyl, isopropyl, and butyl are the most preferable.

$R_7$ and $R_8$ represent hydrogen, halogen atoms, or substituents, preferably the hydrogen atom or the substituents, and $R_7$ and $R_8$ may be bound one another to form a ring.

The halogen atoms include fluorine, chlorine, bromine, iodine atoms and the like, and the fluorine and chlorine atoms are preferable. The substituents include the same substituents included in the examples of the above $R_4$ and $R_5$. The alkyl and aryl groups are preferable, and the alkyl group is more preferable. Among the alkyl groups, methyl, ethyl, propyl, isopropyl, butyl, isobutyl, sec-butyl, pentyl and neopentyl are preferable, and methyl is the most preferable. $R_7$ and $R_8$ may be bound one another to form a 5- to 6-membered ring, and the 5- to 6-membered rings include a cyclopentane, cyclohexane, benzene, pyridine, naphthalene rings, and the benzene ring is preferable.

Subsequently, the general formula (III) will be described.

In the general formula (III), $R_1'$ represents an alkyl group.

The alkyl group includes for example, methyl, ethyl, propyl, isopropyl, tert-butyl, pentyl, hexyl, octyl, dodecyl, tridecyl, tetradecyl, pentadecyl, and the like.

A branched alkyl group is preferable.

The branched alkyl group includes for example, isopropyl, tert-butyl, isobutyl, sec-butyl, neo-pentyl, tert-amyl and the like, and isopropyl and tert-butyl are the most preferable.

$R_2'$ represents an alkyl, acyl or carbamoyl group.

The alkyl groups include, for example, methyl, ethyl, propyl, isopropyl, tert-butyl, pentyl, hexyl, octyl, dodecyl, tridecyl, tetradecyl, pentadecyl, and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, and the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like.

The alkyl and acyl groups are preferable.

Among the alkyl groups, methyl, ethyl, propyl, isopropyl, butyl and tert-butyl are preferable, and methyl is the most preferable.

Among the acyl groups, acetyl, ethylcarbonyl, propylcarbonyl, butylcarbonyl and isobutylcarbonyl are preferable, and acetyl and isobutylcarbonyl are the most preferable.

In the invention, the total number of the carbon atoms in $R_1'$ and $R_2'$ is 3 or more. That is, when the total number of the carbon atoms in $R_1'$ and $R_2'$ is 3 or more, the solvent solubility becomes better.

$R_3$ represents an alkyl, alkenyl or aryl group.

The alkyl groups include, for example, methyl, ethyl, propyl, isopropyl, tert-butyl, pentyl, hexyl, octyl, dodecyl, tridecyl, tetradecyl, pentadecyl, and the like, the alkenyl groups include for example, vinyl, allyl and the like, and the aryl groups include for example, phenyl, naphthyl and the like.

The alkyl groups are preferable. Among the alkyl groups, methyl, ethyl, propyl, isopropyl, butyl, isobutyl, sec-butyl, pentyl and neopentyl are preferable, and methyl, ethyl, propyl, isopropyl, and butyl are the most preferable.

$R_{13}$ represents a halogen atom or a substituent.

The halogen atoms include fluorine, chlorine, bromine, iodine atoms and the like.

The fluorine and chlorine atoms are preferable.

The substituent includes the same substituents included in the examples of the above $R_4$ and $R_5$.

An alkyl, alkoxy, alkylthio, alkoxycarbonyl, sulfamoyl, acyl, acyloxy, amide, carbamoyl, amino, cyano and nitro groups are preferable, and the alkyl group is more preferable. Among the alkyl groups, methyl, ethyl, propyl, isopropyl, butyl, isobutyl, sec-butyl, pentyl and neopentyl are preferable, and methyl is the most preferable.

A sign, l represents an integer of 0 to 4.

When l is 2 or more, $R_{13}$ may be the same or different.

Subsequently, the general formula (IV) will be described.

In the general formula (IV), $R_1''$ represents a trifluoromethyl, alkoxycarbonyl, acyl, carbamoyl, or cyano group.

The alkoxycarbonyl groups include for example, methyloxycarbonyl, ethyloxycarbonyl, butyloxycarbonyl, octyloxycarbonyl, dodecyloxycarbonyl and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, and the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like.

The trifluoromethyl, alkoxycarbonyl and cyano groups are preferable.

Among the alkoxycarbonyl groups, methyloxycarbonyl and ethyloxycarbonyl are preferable.

$R_2$" represents an alkyl, acyl or carbamoyl group.

The alkyl groups include, for example, methyl, ethyl, propyl, isopropyl, tert-butyl, pentyl, hexyl, octyl, dodecyl, tridecyl, tetradecyl, pentadecyl, and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, and the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like.

The alkyl and acyl groups are preferable.

Among the alkyl groups, methyl, ethyl, propyl, isopropyl, butyl and tert-butyl are preferable, and methyl is the most preferable.

Among the acyl groups, acetyl, ethylcarbonyl, propylcarbonyl, butylcarbonyl and isobutylcarbonyl are preferable, and acetyl and isobutylcarbonyl are the most preferable.

In the invention, the total number of the carbon atoms in $R_1$" and $R_2$" is 3 or more. That is, when the total number of the carbon atoms in $R_1$" and $R_2$" is 3 or more, the solvent solubility becomes better.

$R_3$ represents an alkyl, alkenyl or aryl group.

The alkyl groups include, for example, methyl, ethyl, propyl, isopropyl, tert-butyl, pentyl, hexyl, octyl, dodecyl, tridecyl, tetradecyl, pentadecyl, and the like, the alkenyl groups include for example, vinyl, allyl and the like, and the aryl groups include for example, phenyl, naphthyl and the like.

The alkyl groups are preferable. Among the alkyl groups, methyl, ethyl, propyl, isopropyl, butyl, isobutyl, sec-butyl, pentyl and neopentyl are preferable, and methyl, ethyl, propyl, isopropyl, and butyl are the most preferable.

$R_4$' and $R_5$' represent hydrogen atoms, halogen atoms, or substituents, $R_{14}$ represents a halogen atom or a substituent, and m represents an integer of 0 to 4.

$R_4$' and $R_5$' are the same as defined for $R_4$ and $R_5$ in the general formula (I), and preferably represent the hydrogen atoms or the alkyl groups. Among the alkyl groups, methyl, ethyl, propyl, isopropyl, butyl, isobutyl, sec-butyl, pentyl and neopentyl are preferable, and methyl and ethyl are the most preferable.

$R_{14}$ is the same as defined for $R_{13}$ in the general formula (III), and preferably represents the alkyl group. Among the alkyl groups, methyl, ethyl, propyl, isopropyl, butyl, isobutyl, sec-butyl, pentyl and neopentyl are preferable, and methyl and ethyl are the most preferable.

A sign, m represents an integer of 0 to 4.

When m is 2 or more, $R_{14}$ may be the same or different.

$R_4$', $R_5$' and $R_{14}$ substituted on adjacent carbon atoms may be bound one another to form a ring.

Subsequently, the general formula (V) will be described.

In the general formula (V), $R_1$' represents an alkyl group.

The alkyl group includes for example, methyl, ethyl, propyl, isopropyl, tert-butyl, pentyl, hexyl, octyl, dodecyl, tridecyl, tetradecyl, pentadecyl, and the like.

A branched alkyl group is preferable.

The branched alkyl group includes for example, isopropyl, tert-butyl, isobutyl, sec-butyl, neo-pentyl, tert-amyl and the like, and isopropyl and tert-butyl are the most preferable.

$R_2$' represents an alkyl, acyl or carbamoyl group.

The alkyl groups include, for example, methyl, ethyl, propyl, isopropyl, tert-butyl, pentyl, hexyl, octyl, dodecyl, tridecyl, tetradecyl, pentadecyl, and the like, the acyl groups include for example, acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl and the like, and the carbamoyl groups include for example, aminocarbonyl, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl and the like.

The alkyl and acyl groups are preferable.

Among the alkyl groups, methyl, ethyl, propyl, isopropyl, butyl and tert-butyl are preferable, and methyl is the most preferable.

Among the acyl groups, acetyl, ethylcarbonyl, propylcarbonyl, butylcarbonyl and isobutylcarbonyl are preferable, and acetyl and isobutylcarbonyl are the most preferable.

In the invention, the total number of the carbon atoms in $R_1$' and $R_2$' is 3 or more. That is, when the total number of the carbon atoms in $R_1$' and $R_2$' is 3 or more, the solvent solubility becomes better.

$R_3$ represents an alkyl, alkenyl or aryl group.

The alkyl groups include, for example, methyl, ethyl, propyl, isopropyl, tert-butyl, pentyl, hexyl, octyl, dodecyl, tridecyl, tetradecyl, pentadecyl, and the like, the alkenyl groups include for example, vinyl, allyl and the like, and the aryl groups include for example, phenyl, naphthyl and the like.

The alkyl groups are preferable. Among the alkyl groups, methyl, ethyl, propyl, isopropyl, butyl, isobutyl, sec-butyl, pentyl and neopentyl are preferable, and methyl, ethyl, propyl, isopropyl, and butyl are the most preferable.

$R_{15}$ represents a halogen atom or a substituent.

$R_{15}$ is the same as defined for $R_{13}$ in the general formula (III), and preferably represents a hydrogen atom or the alkyl group. Among the alkyl groups, methyl, ethyl, propyl, isopropyl, butyl, isobutyl, sec-butyl, pentyl and neopentyl are preferable, and methyl and ethyl are the most preferable.

A sign, n represents an integer of 0 to 4.

When n is 2 or more, $R_{15}$ may be the same or different.

$R_{15}$ substituted on adjacent carbon atoms may be bound one another to form a ring.

A combination of $R_1$, X and Y is extremely important for color reproducibility, and the better color reproducibility can be exerted by combining the above general formulae (II), (III), (IV) and (V).

Representative specific examples of the colorants according to the present invention represented by the above general formulae (I), (II), (III), (IV) and (V) are shown below, but the invention is not limited thereto.

[Exemplified Compounds]

1.

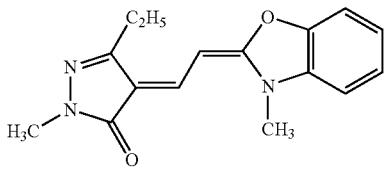

-continued
2.
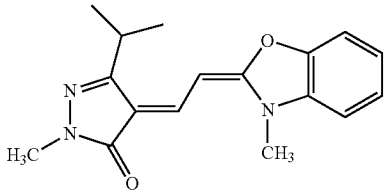
3.
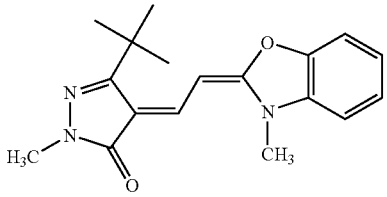
4.
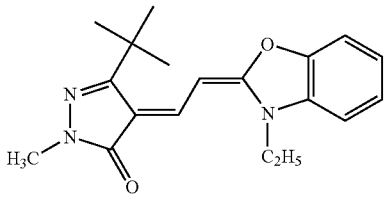
5.
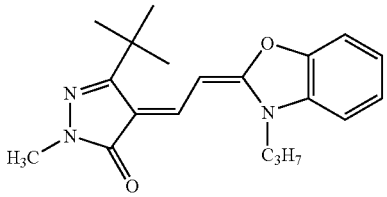
6.
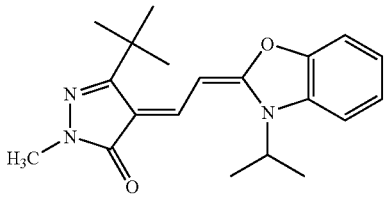
7.
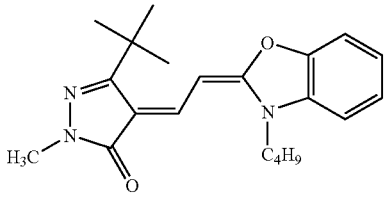
8.
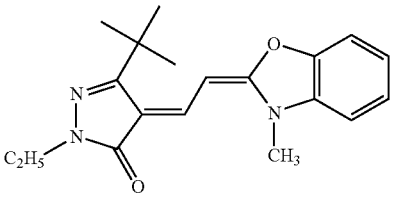
9.
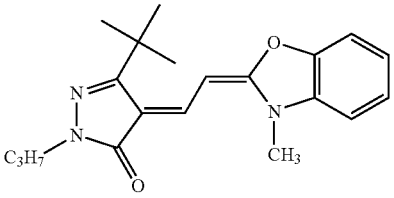
-continued
10.
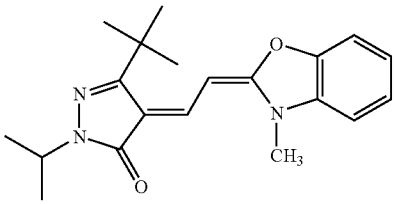
11.
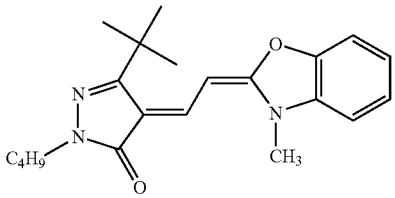
12.
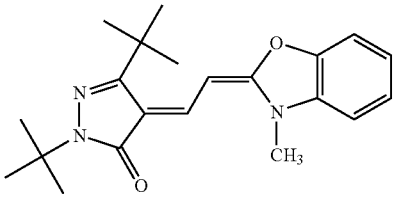
13.
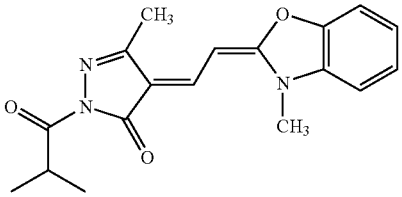
14.
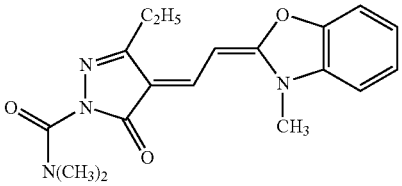
15.
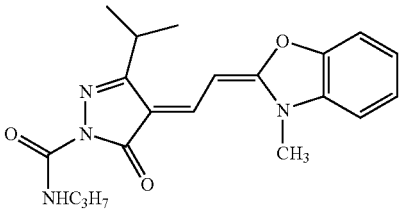
16.
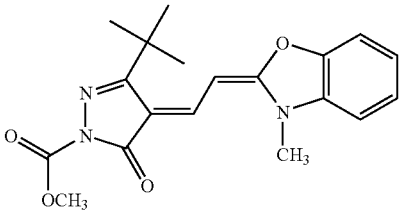

-continued
18.
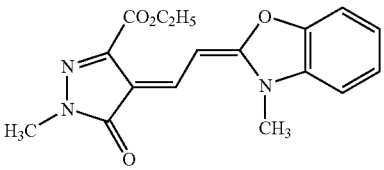
20.
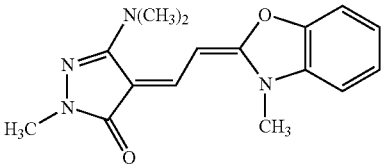
22.
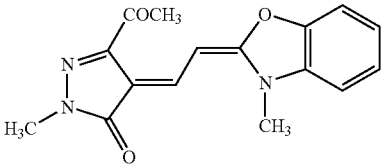
23.
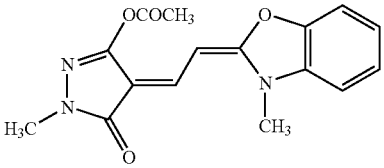
24.
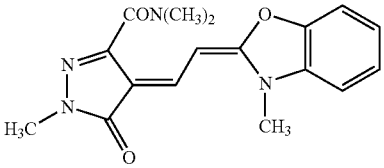
25.
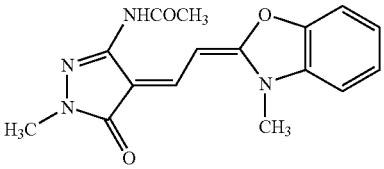
26.
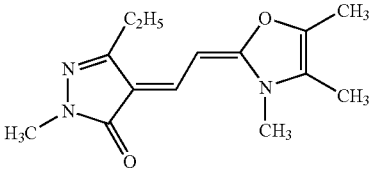
27.
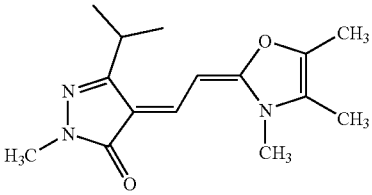
-continued
28.
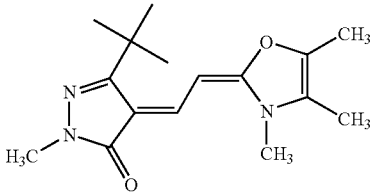
29.
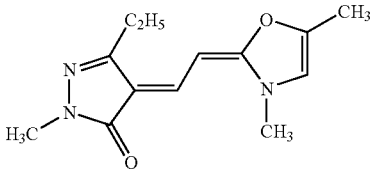
30.
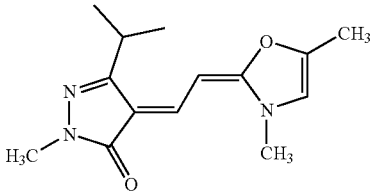
31.
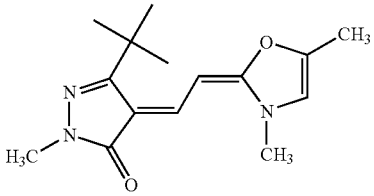
32.
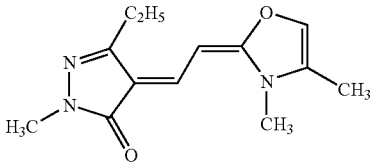
33.
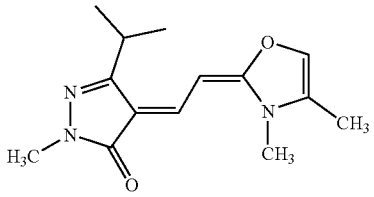
34.
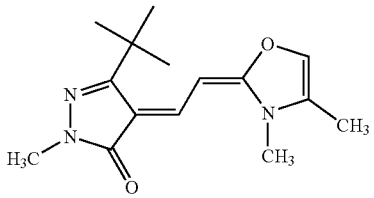
35.
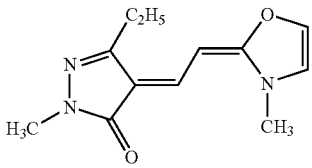

-continued
36.
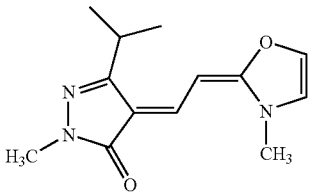
37.
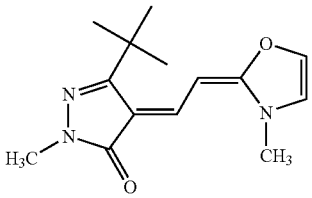
39.
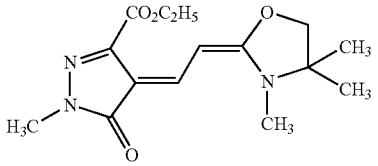
42.
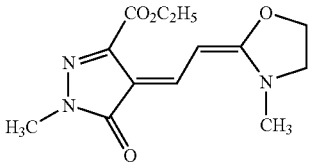
44.
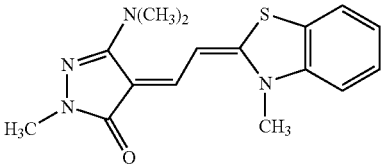
46.
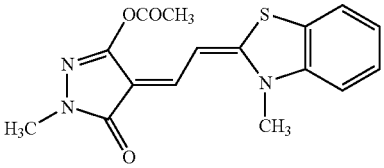
47.
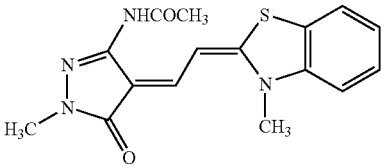
48.
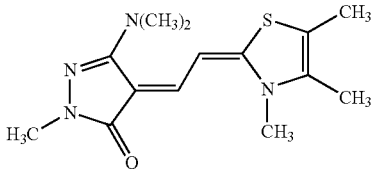
-continued
50.
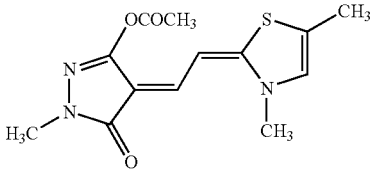
51.
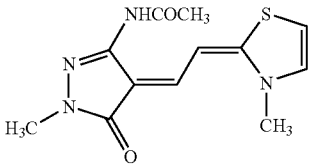
52.
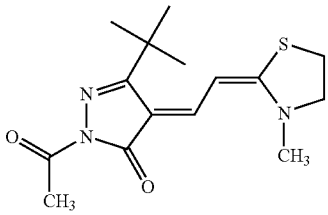
53.
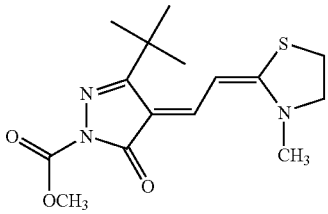
54.
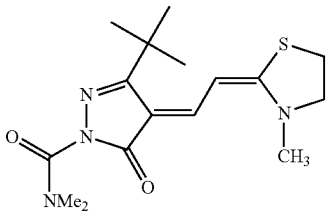
55.
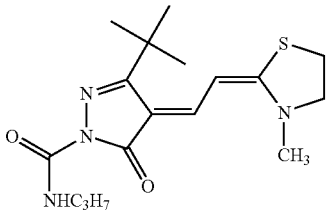
56.
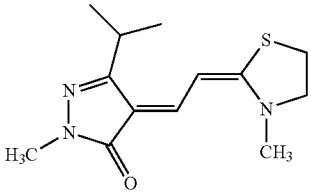

-continued
57.
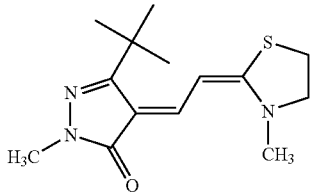
58.
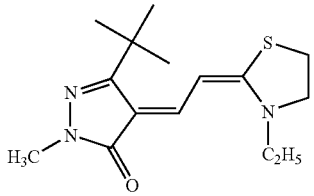
59.
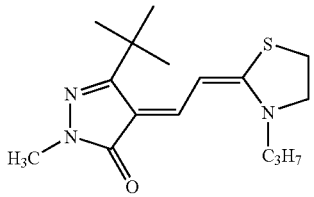
60.
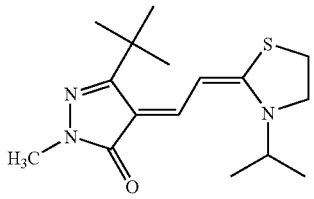
61.
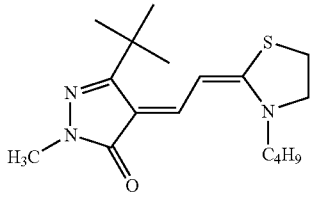
62.
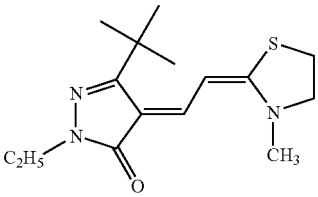
63.
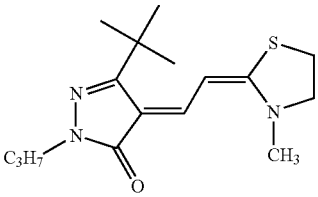
-continued
64.
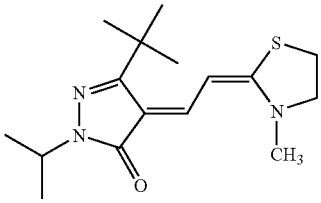
65.
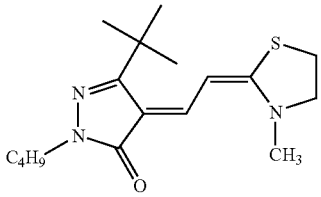
66.
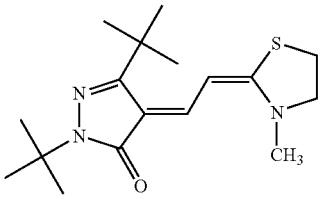
67.
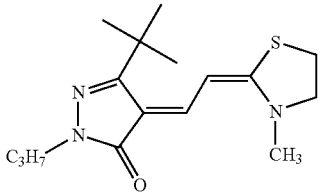
68.
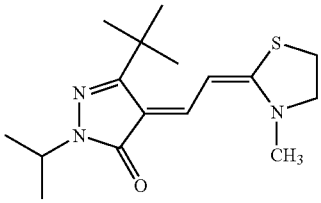
69.
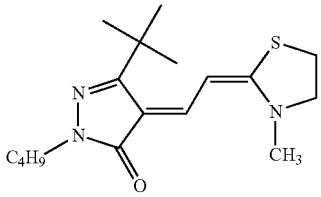
70.
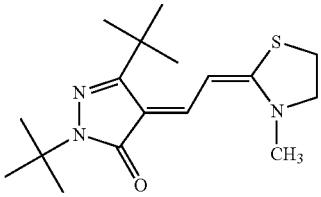
72.
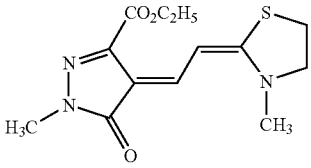

-continued
74.
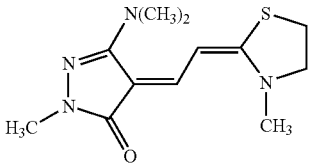
76.
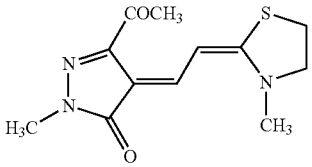
77.
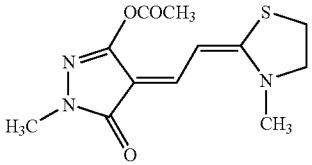
78.
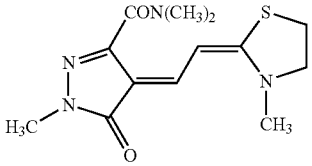
79.
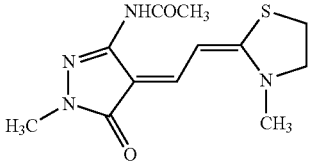
80.
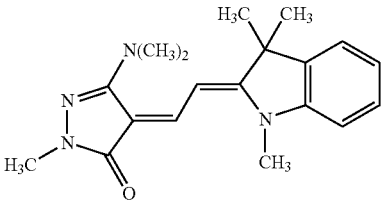
81.
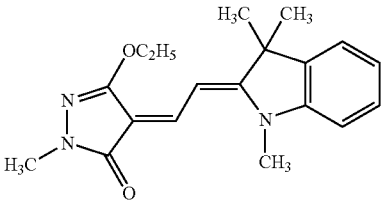
82.
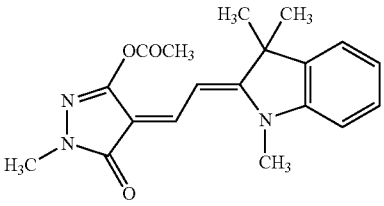
-continued
83.
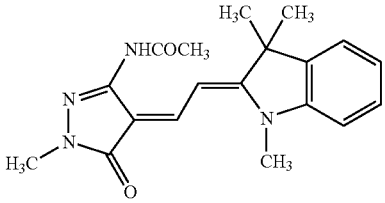
84.
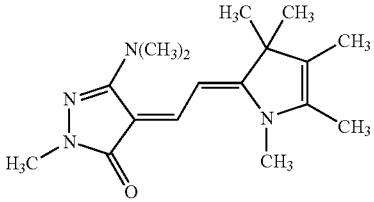
85.
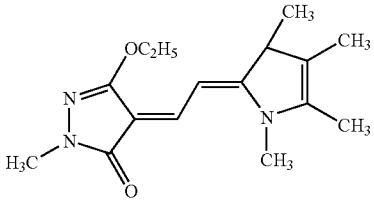
86.
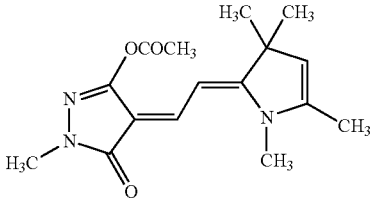
87.
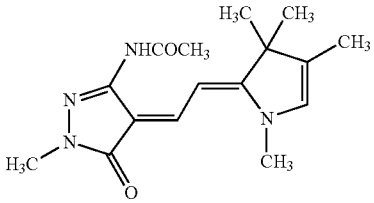
88.
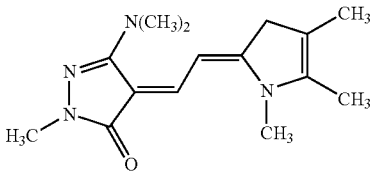
89.
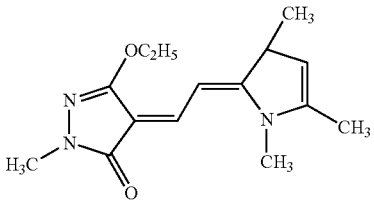

-continued
90.
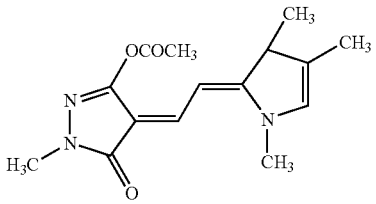
91.
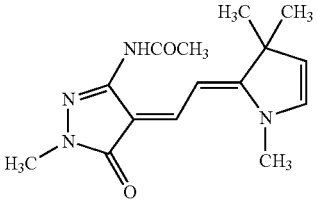
92.
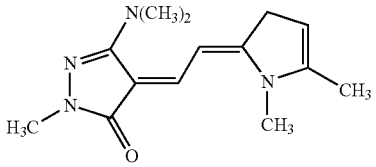
93.
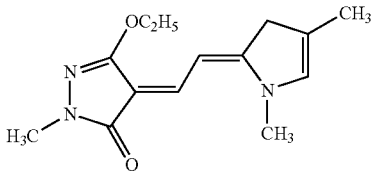
94.
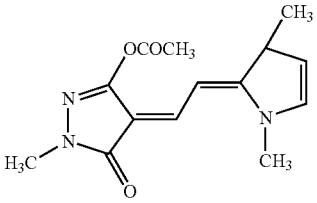
95.
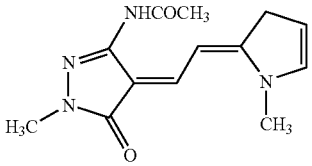
97.
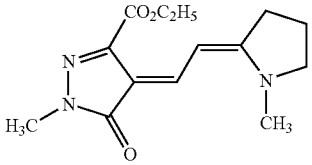
99.
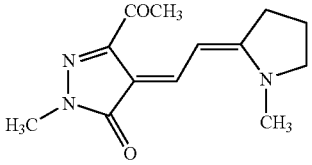
-continued
100.
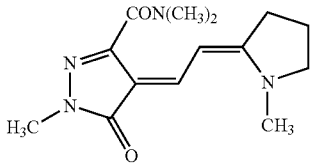
102.
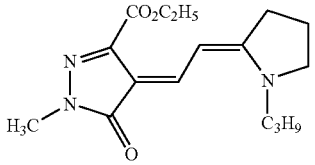
104.
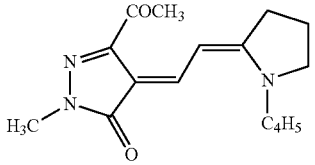
105.
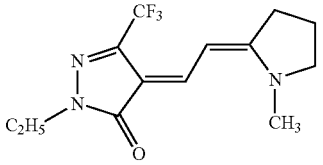
106.
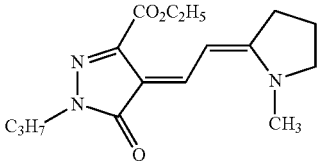
107.
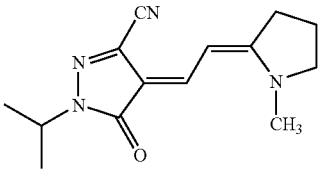
108.
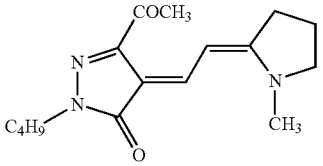
109.
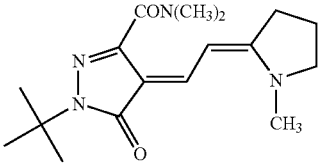
110.
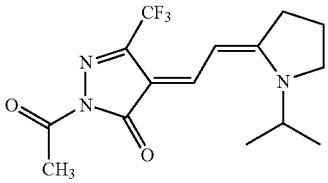

-continued
111.
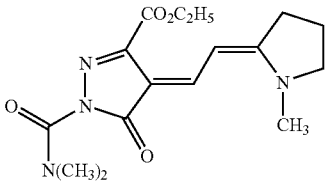
112.
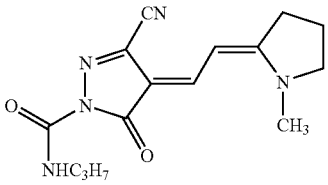
113.
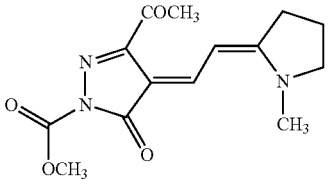
115.
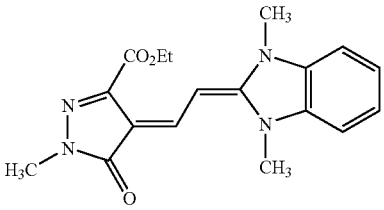
117.
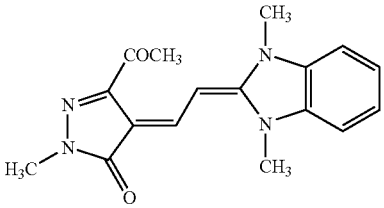
118.
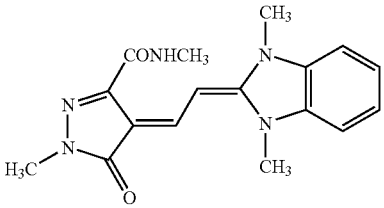
120.
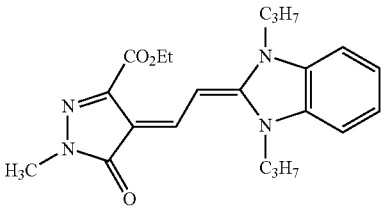
-continued
122.
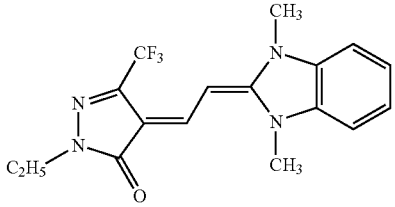
123.
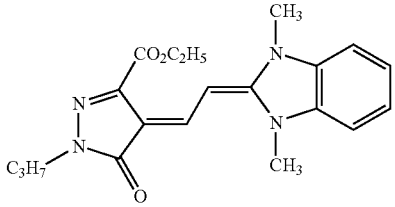
124.
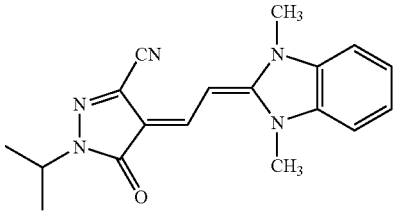
125.
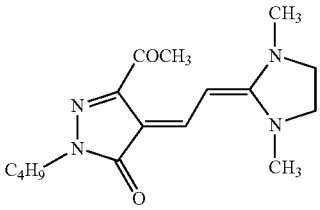
126.
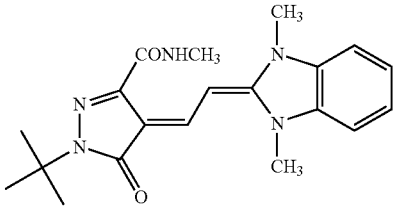
127.
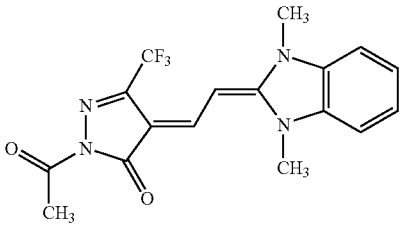
128.
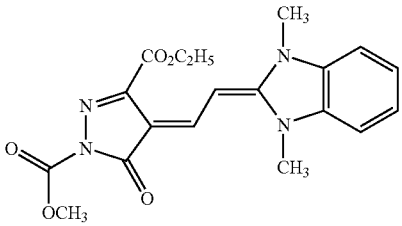

-continued
129.
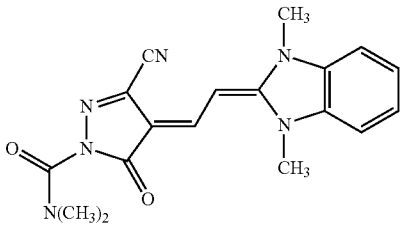
130.
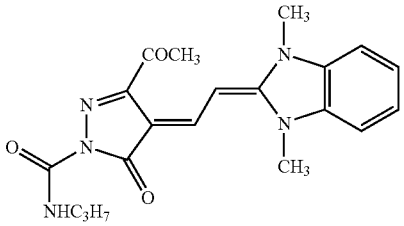
132.
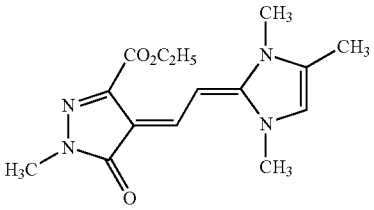
134.
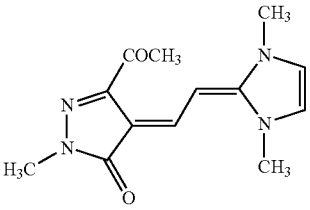
135.
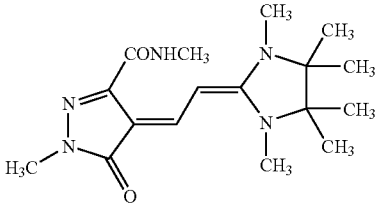
137.
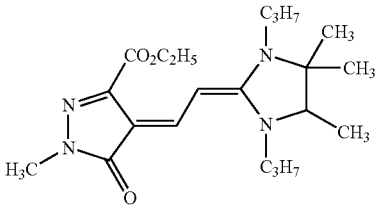
139.
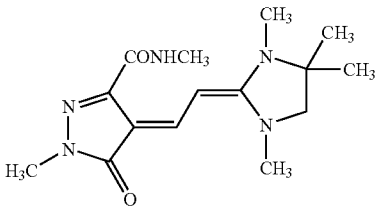
-continued
141.
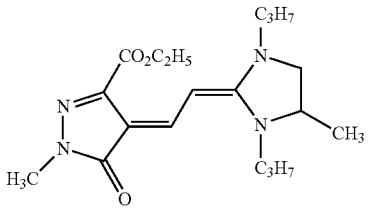
143.
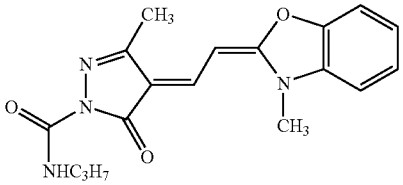
144.
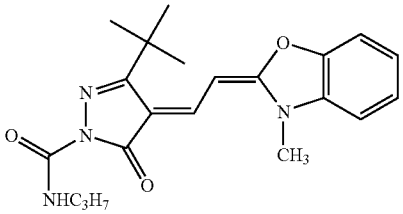
145.
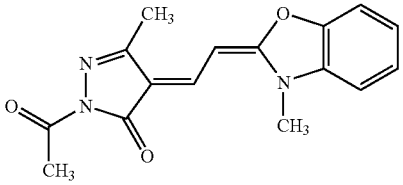
146.
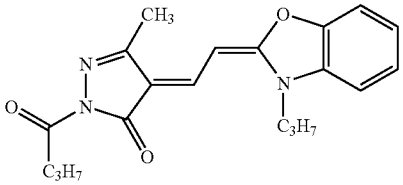
147.
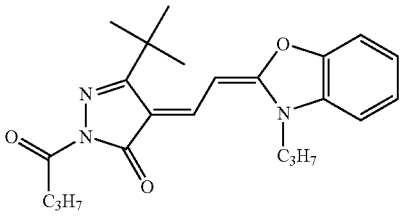
148.
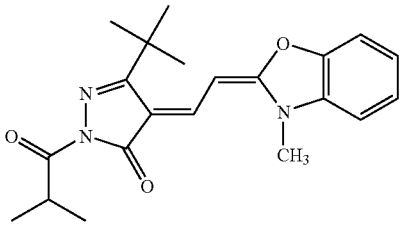

-continued

149.

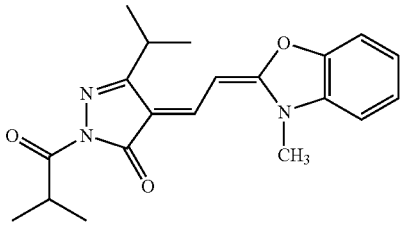

150.

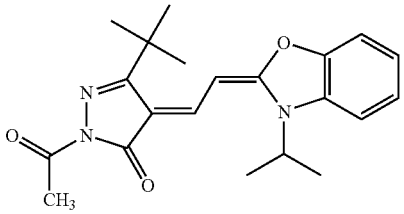

151.

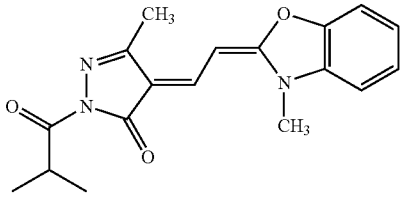

152.

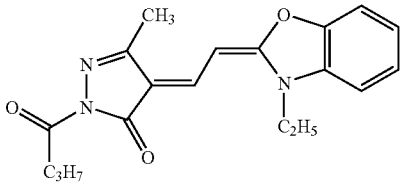

Synthesis examples of the colorants represented by the general formulae (I) to (V) will be shown below.

SYNTHESIS EXAMPLE 1

Synthesis of Exemplified Compound 3

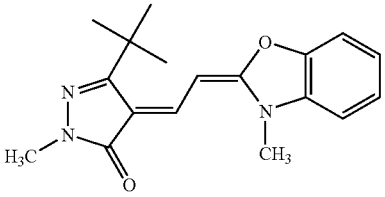

3-tert-Butyl-1-methyl-5-pyrazolone (7.71 g), 21.01 g of 2-[2-(acetyl-phenyl-amino)-vinyl]-3-methylbenzoxazole-3-nium; iodide and 10.01 g of triethylamine were added to 300 mL of ethanol, and reacted by heating at about 80° C. for about 3 hours. After the completion of the reaction, ethanol and triethylamine were removed under reduced pressure, and subsequently the resulting residue was recrystallized from acetonitrile to yield 6.79 g of the exemplified compound 3. The yielded solid was identified as the exemplified compound 3 by analyzing by 1H-NMR and mass spectrum.

SYNTHESIS EXAMPLE 2

Synthesis of Exemplified Compound 13

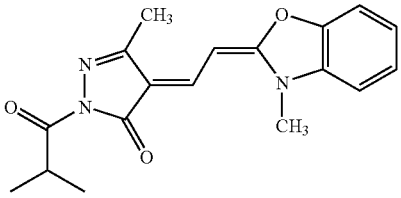

3-tert-Butyl-1-isopropanoyl-5-pyrazolone (8.41 g), 21.01 g of 2-[2-(acetyl-phenyl-amino)-vinyl]-3-methylbenzoxazole-3-nium; iodide and 10.01 g of triethylamine were added to 300 mL of ethanol, and reacted by heating at about 80° C. for about 3 hours. After the completion of the reaction, ethanol and triethylamine were removed under reduced pressure, and subsequently the resulting residue was recrystallized from acetonitrile to yield 9.09 g of the exemplified compound 13. The yielded solid was identified as the exemplified compound 13 by analyzing by 1H-NMR and mass spectrum.

SYNTHESIS EXAMPLE 3

Synthesis of Exemplified Compound 28

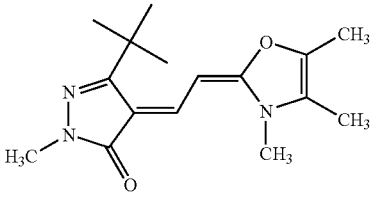

3-tert-Butyl-1-methyl-5-pyrazolone (7.71 g), 19.91 g of 2-[2-(acetyl-phenyl-amino)-vinyl]-3,4,5-trimethylbenzoxazole-3-nium; iodide and 10.01 g of triethylamine were added to 300 mL of ethanol, and reacted by heating at about 80° C. for about 3 hours. After the completion of the reaction, ethanol and triethylamine were removed under reduced pressure, and subsequently the resulting residue was recrystallized from acetonitrile to yield 6.51 g of the exemplified compound 28. The yielded solid was identified as the exemplified compound 28 by analyzing by 1H-NMR and mass spectrum.

SYNTHESIS EXAMPLE 4

Synthesis of Exemplified Compound 57

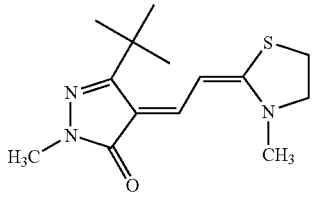

3-tert-Butyl-1-methyl-pyrazolone (7.71 g), 19.41 g of 2-[2-(acetyl-phenyl-amino)-vinyl]-3-methyl-4,5-dihydro-thiazole-3-nium; iodide and 10.01 g of triethylamine were added to 300 mL of ethanol, and reacted by heating at about 80° C. for 3 hours. After the completion of the reaction, ethanol and triethylamine were removed under reduced pressure, and subsequently the resulting residue was recrystallized from ethyl acetate and hexane to yield 4.75 g of the exemplified compound 57. The yielded solid was identified as the exemplified compound 57 by analyzing by 1H-NMR and mass spectrum.

SYNTHESIS EXAMPLE 5

Synthesis of Exemplified Compound 97

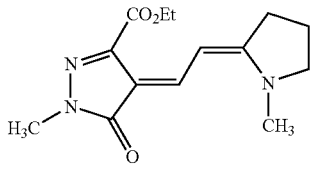

3-Carboxylate ethyl ester-1-methyl-5-pyrazolone (10.51 g), 16.41 g of 1-methyl-5-(2-phenylamino-vinyl)-3,4-dihydropyrrole-nium; iodide, 5.01 g of triethylamine and 5.10 g of acetic acid anhydrate were added to 100 mL of pyridine, and reacted by heating at about 80° C. for 3 hours. After the completion of the reaction, pyridine and triethylamine were removed under reduced pressure, and subsequently the resulting residue was recrystallized from ethyl acetate and hexane to yield 6.41 g of the exemplified compound 97. The yielded solid was identified as the exemplified compound 97 by analyzing by 1H-NMR and mass spectrum.

SYNTHESIS EXAMPLE 6

Synthesis of Exemplified Compound 115

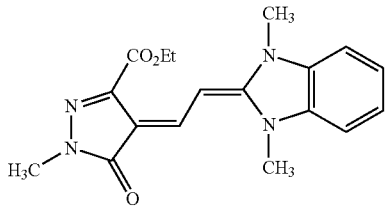

3-Carboxylate ethyl ester-1-methyl-5-pyrazolone (10.51 g), 19.56 g of 1,3-dimethyl-2-(2-phenylamino-vinyl)-benzimidazole-1-nium; iodide, 5.01 g of triethylamine and 5.10 g of acetic acid anhydrate were added to 100 mL of pyridine, and reacted by heating at about 80° C. for 3 hours. After the completion of the reaction, pyridine and triethylamine were removed under reduced pressure, and subsequently the resulting residue was recrystallized from acetonitrile to yield 11.16 g of the exemplified compound 115. The yielded solid was identified as the exemplified compound 115 by analyzing by 1H-NMR and mass spectrum.

Other colorants according to the present invention can be easily synthesized in accordance with the above synthesis methods.

The thermal transfer recording material (also referred to as a thermal transfer sheet) of the invention will be described below.

(Support)

A support used for the thermal transfer recording material of the invention is not particularly limited, and the same supports as those used for the thermal transfer sheet in earlier development can be used without any particular limitation. Specific examples of the preferable support include thin paper such as glassine paper, condenser paper and paraffin paper, polyester with high heat resistance such as polyethylene terephthalate, polyethylene terenaphthalate, polyphenylene sulfide, polyether ketone and polyether sulfone, stretched or unstretched film of plastics such as polypropylene, polycarbonate, cellulose acetate, polyethylene derivatives, polyvinyl chloride, polyvinylidene chloride, polystyrene, polyamide, polyimide, polymethylpentene and ionomers, and laminates thereof.

A thickness of this support can be appropriately selected so that strength, heat conductivity and heat resistance are adequate, and typically the thickness of about 1 to 100 μm is preferable.

In the support as the above, when adhesiveness to a colorant providind layer (also referred to as a thermal transfer layer or an ink layer) formed on the surface thereof is poor, it is preferable to give a primer treatment or a corona treatment onto the surface.

(Ink Layer)

In the present invention, at least one of the colorants represented by the general formulae (I) to (V) of the invention is used as thermally diffusible ink contained in an ink layer provided on one side of the support.

An addition amount of the colorant used for the invention is typically preferably 0.05 to 20 g and more preferably 0.1 to 5 g based on 1 $m^2$ of the ink layer described later.

(Binder)

A binder resin used for the ink layer includes water-soluble polymers such as cellulose, polyacrylic, polyvinyl alcohol and polyvinyl pyrrolidone type polymers, and organic solvent-soluble polymers such as acrylic resin, methacrylic resin, polystyrene, polycarbonate, polysulfone, polyether sulfone, polyvinyl butyral, polyvinyl acetal, ethylcellulose and nitrocellulose. Among these resins, polyvinyl butyral, polyvinyl acetal and cellulose type resins which are excellent in storage stability are preferable. When the polymer soluble in the organic solvent is used, the polymer may be used not only by dissolving in one or two or more organic solvents but also by making a latex dispersion. The amount of the binder resin to be used is preferably 0.1 to 50 g based on 1 $m^2$ of the support.

In order to enhance release property from a colorant image-receiving layer (also referred to as a dye image-receiving layer), a release agent may be added or a distinct release later containing the release agent may be provided. As the release agent, it is possible to use reaction curable silicone, a phosphate ester type surfactant and a fluorine compound. The amount of the release agent to be used is preferably 0.5 to 40% by mass based on a solid content of the layer in which the release agent is contained. When the release layer is provided, it is possible to use the same binder as that used in the above ink layer.

(BC Layer: also Referred to as a Back Coat Layer, a Back Coating Layer, a Sticking Prevention Layer or a Back Face Layer)

It is preferable to provide a BC layer for imparting the heat resistance and stable traveling performance of the thermal transfer sheet, on the side of the support, opposite to the side on which the ink layer is provided. Binder resins used for the BC layer include acrylic type resins such as methyl polymethacrylate, ethyl polyacrylate, polyacrylamide and acrylonitrile-styrene copolymer, cellulose type resins such as ethylcellulose, hydroxycellulose, hydroxypropylcellulose, methylcellulose, cellulose acetate, cellulose acetate butyrate and nitrocellulose, vinyl type resins such as polyvinyl alcohol, polyvinyl acetate, polyvinyl butyral, polyvinyl acetal and polyvinyl pyrrolidone, polyamide resins, polyvinyl toluene resins, coumarone-indene resins, polyester resins, polyurethane resins, silicone modified or fluorine modified urethane.

These resins may be used by mixing. In order to further enhance the heat resistance of the BC layer, the resin having a reactive group such as hydroxyl group may be used in the above resins, and a crosslinking resin layer may be made by combining polyisocyanate as a crosslinking agent. Furthermore in order to enhance sliding property with a heating procedure such as thermal head, a solid or liquid release agent or lubricant may be added to impart heat resistant sliding property. As the release agent or the lubricant, it is possible to use fine particles of waxes such as polyethylene wax and paraffin wax, higher aliphatic alcohol, organopolysiloxane, anionic surfactant, cationic surfactant, ampholytic surfactant, nonionic surfantant, fluorinated surfactant, organic carboxylic acid and derivatives thereof, fluorinated resins, silicone type resins, and inorganic compound such as talc, silica and molybdenum sulfide. The preferable amount of the lubricant to be added in the BC layer is 5 to 50% and particularly preferably 10 to 30% by mass based on a total solid content of the BC layer. The thickness of the BC layer is preferably about 0.1 to 10 μm after coating and drying.

(Later Heating Treatment)

In the thermal transfer recording used for the present invention, a later heating treatment is carried out by opposing a transferred surface after the colorant (dye) transfer to a surface of a non-transferable resin layer (also referred to as a non-transferable release layer) and giving the heat from the opposite side of the non-transferable resin layer.

The non-transferable resin layer can be also provided on the same phase as that of the above ink layer in so-called phase sequential. When the non-transferable resin layer is used alone as a sheet, the same support and BC layer as those described above can be used.

The same binder resins as those used for the ink layer can be used for the binder resin used for the non-transferable resin layer.

When the non-transferable resin layer is provided in the phase sequential with the ink layer, it is preferable to contain fine particles in the resin layer. This is carried out for the purpose of preventing a so-called kick back phenomenon that the dye slightly migrates into the BC layer when stored in a roll state after coating and the dye which has migrated into BC layer is retransferred to the non-transferable resin layer when made into a small package as a product form. When the kick back occurs, the retransferred dye into the resin layer colors an image receiving surface upon photographic printing, and remarkably impairs an image quality. As the fine particles, it is possible to use resin fine particles of acrylic resins, fluorine resins, polyethylene resins and polystyrene resins or wax particles in addition to inorganic fine particles of silica, alumina and calcium carbonate. A particle size of these fine particles is preferably 0.1 to 50 μm. When the particle size is less than 0.1 μm, the fine particles have no effect on the kick back because the resin layer surface is not concavoconvex. When it is more than 50 μm, the fine particles spoils an image surface after the photographic printing and impairs the image quality. The preferable amount of the above fine particles to be added is 1 to 50%, and particularly preferably 5 to 30% by mass based on the total solid content of the resin layer. When the amount is less than 1% by mass, the fine particles have no effect on the kick back because the resin layer surface is not concavoconvex. When it is more than 50% by mass, the fine particles spoils an image surface after the photographic printing and impairs the image quality.

In the present invention, a metal ion-containing compound may be contained in the resin layer (non-transferable release layer), and the metal ion-containing compound includes inorganic or organic salts of metal ions and metal complexes. Among others, the salt and complex of the organic acid are preferable. The metals include monovalent and polyvalent metals belonging to I to VIII groups in the periodic series. Among others, Al, Co, Cr, Cu, Fe, Mg, Mn, Mo, Ni, Sn, Ti and Zn are preferable, and in particular, Ni, Cu, Cr, Co and Zn are preferable. Specific examples of the metal ion-containing compound include salts of aliphatic acids such as acetic acid and stearic acid with, and salts of aromatic carboxylic acids such as benzoic acid and salicylic acid with $Ni^{2+}$, $Cu^{2+}$, $Cr^{2+}$, $Co^{2+}$ and $Zn^{2+}$.

The addition amount of the metal ion-containing compound used for the invention is typically preferably 0.5 to 20 g/$m^2$, and more preferably 1 to 15 g/$m^2$ based on the support.

The amount of the metal ion-containing compound to be added is preferably 0.01 to 1%, and in particular preferably 0.05 to 0.5% by mass based on the total-solid content of the resin layer. When the amount is less than 1% by mass, the addition effect is low whereas when it is more than 1% by mass, the aforementioned kick back occurs remarkably.

In order to enhance the release property of the colorant image-receiving layer from the non thermally transferable resin layer in the later heating region, the release agent may be added, or the distinct release layer containing the release agent may be provided. As the release agent, it is possible to use the reaction curable silicone, the phosphate ester type surfactant and the fluorine compound. The amount of the release agent to be used is preferably 0.5 to 40% by mass based on the solid content of the layer in which the release agent is contained. When the release agent is provided, it is possible to use the same binder as that used for the above ink layer.

(Protection Layer)

A thermally transferable protection layer (also referred to as a protection transfer layer) is composed of a transparent resin layer which becomes a protection layer which covers the surface of the image formed by the thermal transfer on the image receiving sheet.

As the resins which form the thermally transferable protection layer, for example, polyester resins, polystyrene resins, acrylic resins, polyurethane resins, acrylic urethane resins, polycarbonate resins, and epoxy-modified resins thereof, silicone-modified resins thereof, mixtures thereof, ionizing radiation curable resins thereof, ultraviolet ray blocking resins thereof can be exemplified. The preferable resins include the polyester resins, the polycarbonate resins, the epoxy-modified resins and the ionizing radiation curable resins. As the polyester resin, alicyclic polyester resin having an alicyclic compound with one or more diol components and acid components is preferable. As the polycarbonate resin, aromatic polycarbonate resin is preferable, and the aromatic polycarbonate resin described in JP HEI 11-151867 A is particularly preferable.

The epoxy-modified resin used for the present invention includes epoxy-modified urethane, epoxy-modified polyethylene, epoxy-modified polyethylene terephthalate, epoxy-modified polyphenyl sulfite, epoxy-modified cellulose, epoxy-modified polypropylene, epoxy-modified polyvinyl chloride, epoxy-modified polycarbonate, epoxy-modified acryl, epoxy-modified polystyrene, epoxy-modified methyl polymethacrylate, epoxy-modified silicone, a copolymer of epoxy-modified polystyrene and epoxy-modified methyl polymethacrylate, a copolymer of epoxy-modified acryl and epoxy-modified polystyrene, and a copolymer of epoxy-modified acryl and epoxy-modified silicone. Epoxy-modified acryl, epoxy-modified polystyrene, epoxy-modified methyl polymethacrylate and epoxy-modified silicone are preferable, and the copolymer of epoxy-modified polystyrene and epoxy-modified methyl polymethacrylate, the copolymer of epoxy-modified acryl and epoxy-modified polystyrene, and the copolymer of epoxy-modified acryl and epoxy-modified silicone are more preferable.

(Ionizing Radiation Curable Resin)

An ionizing radiation curable resin can be used as the thermally transferable protection layer. The thermally transferable protection layer becomes excellent in plasticizer resistance and abrasion resistance by containing it. As the ionizing radiation curable resin, those known publicly can be used without particular limitation. For example, it is possible to use one obtained by crosslinking and curing a radically polymerizable polymer or oligomer by the irradiation of the ionizing radiation, and if necessary, adding a photopolymerizable initiator and polymerizing and crosslinking by electron ray or ultraviolet ray.

(Ultraviolet Ray Blocking Resin)

A protection layer containing an ultraviolet ray blocking resin can be used as the thermally transferable protection layer. This protection layer containing the ultraviolet ray blocking resin is primarily intended to impart the light resistance to a photographically printed matter. As the ultraviolet ray blocking resin, it is possible to use the resin obtained by reacting and binding a reactive ultraviolet ray absorbing agent to thermoplastic resin or the above ionizing radiation curable resin. More specifically, it is possible to exemplify one obtained by introducing a reactive group such as addition polymerizable double bond (e.g., vinyl, acryloyl, methacryloyl groups), alcoholic hydroxyl, amino, carboxyl, epoxy and isocyanate groups into a non-reactive organic ultraviolet ray absorbing agent known in the art such as salicylate, benzophenone, benzotriazole, substituted acrylonitrile, nickel chelated, hindered amine types.

The thickness of the thermally transferable protection layer having a single layer structure as the above or a main protection layer provided in the thermally transferable protection layer having a multilayer structure is typically about 0.5 to 10 μm, depending on a type of the resin for forming the protection layer.

It is preferable to provide the thermally transferable protection layer of the present invention on the support of the thermal transfer sheet via the non-transferable release layer.

It is preferable that the non-transferable release layer (1) contains 30 to 80% by mass inorganic fine particles with an average particle size of 40 nm or less with the resin binder, (2) contains a copolymer of alkyl vinyl ether and maleic acid anhydrate, a derivative thereof or a mixture thereof at 20% by mass or more as a total, or (3) contains an ionomer at 20% by mass or more, for the purpose of making an adhesive power between the support and the non-transferable release layer always sufficiently higher than an adhesive power between the non-transferable release layer and the thermally transferable protection layer (protection transfer layer), and making the adhesive power between the non-transferable release layer and the thermally transferable protection layer before heating higher than that after heating. Other additives may be contained in the non-transferable release layer if necessary.

As the inorganic fine particles, for example, it is possible to use silica fine particles of silica anhydrate and colloidal silica, and metal oxide such as zinc oxide and zinc antimonate. The particle size of the inorganic fine particles is preferably 40 nm or less. When the particle size is more than 40 nm, it is not preferable because the surface of the thermally transferable protection layer becomes highly concavoconvex due to the concavoconvex surface of the release layer and consequently the transparency of the protection layer is reduced.

The resin binder mixed with the inorganic particles is not particularly limited, and any resins capable of being mixed can be used. For example, polyvinyl alcohol resins (PVA) with various saponification degrees; polyvinyl acetal resins; polyvinyl butyral resins; acrylic type resins; polyamide type resins; cellulose type resins such as cellulose acetate, alkyl cellulose, carboxymethylcellulose and hydroxyalkylcellulose; polyvinyl pyrrolidone resins are included.

A combination ratio (inorganic fine particles/other combined ingredients) of the inorganic fine particles with the other combined ingredients whose main body is the resin binder is preferably in the range of 30/70 or more and 80/20 or less by a mass ratio. When the combination ratio is less than 30/70, the effect of the inorganic fine particles becomes insufficient whereas when it is more than 80/20, the release layer does not form a complete film, and the support and the thermally transferable protection layer are directly contacted in part.

As the copolymer of alkyl vinyl ether and maleic acid anhydrate or the derivative thereof described in the above (2), it is possible to use, for example, one where the alkyl group in an alkyl vinyl ether moiety is methyl or ethyl, or one where a maleic acid anhydrate moiety is partially or completely half-esterified with alcohol (e.g., methanol, ethanol, propanol, isopropanol, butanol, isobutanol).

The release layer may be formed only from the copolymer of alkyl vinyl ether and maleic acid anhydrate, the derivative thereof or the mixture thereof, but the other resin or fine particles may be further added for the purpose of regulating a releasing power between the release layer and the protection layer. In that case, it is preferable to contain the copolymer of alkyl vinyl ether and maleic acid anhydrate, the derivative thereof or the mixture thereof at 20% by mass or more. When the amount to be contained is less than 20% by mass, the effect of the copolymer of alkyl vinyl ether and maleic acid anhydrate, the derivative thereof becomes insufficient.

A resin or fine particles combined in the copolymer of alkyl vinyl ether and maleic acid anhydrate or the derivative thereof are not particularly limited as long as they can be mixed and have high film transparency upon the film formation, and any materials can be used. For example, the aforementioned inorganic fine particles and the resin binder capable of being mixed with the inorganic fine particles are preferably used.

As the ionomer described in the above (3), for example, Surlyn A (supplied from DuPont) and Chemipearl S series (supplied from Mitsui Petroleum Chemical Ind., Ltd.) can be used. The aforementioned inorganic fine particles, the resin binder capable of being mixed with the inorganic fine particles, or other resins and fine particles can be added to the ionomer.

To form the non-transferable release layer, a coating solution containing any ingredient of the above (1) to (3) at a given combination percentage is prepared, such a coating solution is applied on the support by a publicly known method such as gravure coating and gravure reverse coating, and an applied layer is dried. The thickness of the non-transferable release layer is about 0.1 to 2 μm after drying.

The thermally transferable protection layer laminated on the support via or not via the non-transferable release layer may take a multilayer structure or a single layer structure. When it takes the multilayer structure, an adhesive layer arranged on an outmost surface of the thermally transferable protection layer for enhancing the adhesiveness between the thermally transferable protection layer and the image receiving surface of the photographically printed matter, an auxiliary protection layer, a layer (e.g., anti-counterfeit layer, hologram layer) for adding a function other than the original function of the protection layer may be provided in addition to the major protection layer which is a main body for imparting various durability. An order of the main protection layer and the other layers is optional, but typically, the other layers are arranged between the adhesive layer and the main protection layer so that the main protection layer is the outmost surface of the image receiving material or the image receiving sheet after the transfer.

On the outmost surface of the thermally transferable protection layer, the adhesive layer (also referred to as a thermal adhesive layer) may be formed. The adhesive layer can be formed from the resin with good adhesiveness upon heating, such as acrylic resins, vinyl acetate resins, copolymer resin of vinyl chloride and vinyl acetate, polyester type resins and polyamide type resins. The aforementioned ionizing radiation curable resin and the ultraviolet ray blocking resin may be mixed if necessary in addition to the above resins. The thickness of the adhesive layer is typically 0.1 to 5 μm.

To form the thermally transferable protection layer on the non-transferable release layer or the support, for example, a coating solution for the protection layer containing the resin for forming the protection layer, a coating solution for the adhesive layer containing the thermal adhesive resin and the other coating solution for forming the layer added as needed are previously prepared, they are applied in a given order on the non-transferable release layer or the support, and dried. Each coating solution may be applied by a known method. An appropriate primer layer may be provided between respective layers.

(UV Absorbing Agent)

It is preferable that an ultraviolet ray absorbing agent is contained in the thermally transferable protection layer (at least one layer when the thermally transferable protection layer is composed of multiple layers). However, when it is contained in the transparent resin layer, since the transparent resin layer is present on the outmost surface of the photographically printed matter after the transfer of the protection layer, the effect is reduced with time by being affected by the environment for a long time. Thus, in particular, preferably the UV absorbing agent is contained in the thermal adhesive layer.

The ultraviolet ray absorbing agents include salicylic acid type, benzophenone type, benzotriazole type and cyano acrylate type ultraviolet ray absorbing agents, and are commercially available under trade names of TINUVIN R, TINUVIN 234, TINUVIN 320, TINUVIN 326, TINUVIN 327, TINUVIN 328, TINUVIN 312 and TINUVIN 315 (supplied from Ciba-Geigy), SUMISORB-110, SUMISORB-130, SUMISORB-140, SUMISORB-200, SUMISORB-250, SUMISORB-300, SUMISORB-320, SUMISORB-340, SUMISORB-350, SUMISORB-400 (supplied from Sumitomo Chemical Co., Ltd), MARK LA-32, MARK LA-36 and MARK 1413 (supplied from Adeka Argus). Any of them can be used in the present invention.

It is also possible to use a random copolymer where a reactive ultraviolet ray absorbing agent and an acrylic type monomer are randomly copolymerized, which has Tg of 60° C. or more and preferably 80° C.

As the above reactive ultraviolet ray absorbing agent, it is possible to use those where an addition polymerizable double bond of vinyl, acryloyl and methacryloyl groups, or alcoholic hydroxyl, carboxyl, epoxy or isocyanate group is introduced into a salicylate type, benzophenone type, benzotriazole type, substituted acrylonitrile type, nickel chelated or hindered amine type non-reactive ultraviolet ray absorbing agent known in the art. Specifically they are commercially available under trade names of UVA635L and UVA633L (supplied from BASF Japan) and PUVA-30M (supplied from Otsuka Chemical Co., Ltd.). Any of them can be used in the invention.

The amount of the reactive ultraviolet ray absorbing agent in the random copolymer of the reactive ultraviolet ray absorbing agent and the acrylic type monomer as in the above is in the range of 10 to 90%, and preferably 30 to 70% by mass. A molecular weight of such a random copolymer can be about 5,000 to 250,000, and preferably about 9,000 to 30,000. The aforementioned ultraviolet ray absorbing agent and the random copolymer of the reactive ultraviolet ray absorbing agent and the acrylic type monomer may be contained alone or combination of the both. The addition amount of the random copolymer of the reactive ultraviolet ray absorbing agent and the acrylic type monomer is preferably in the range of 5 to 50% by mass based on the layer in which the random copolymer is contained.

Certainly, other light/chemical resistant agents other than the ultraviolet ray absorbing agent may be contained. Herein, the light/chemical resistant agent is a drug which prevents deterioration and degradation of the dye by absorbing or blocking an action which deteriorates or degrades the dye, such as light energy, heat energy and an oxidative action. Specifically, antioxidants and light stabilizers conventionally known as the additives in synthetic resins are included in addition to the aforementioned anti-ultraviolet ray agent. In that case, the drug may be contained in at least one layer of the thermally transferable protection layer, i.e., one of the release layer, the transparent resin layer and the thermal adhesive layer, and in particular, preferably it is contained in the thermal adhesive layer.

The antioxidant includes primary antioxidants such as phenol type, monophenol type, bisphenol type and amine type antioxidants, and secondary antioxidants such as sulfur type and phosphorous type. The light stabilizer includes hindered amine type agents.

The use amount of above light/chemical resistant agent including the ultraviolet ray absorbing agent is not particularly limited, and is preferably 0.05 to 10 parts by mass, and more preferably 3 to 10 parts by mass based on 100 parts by mass of the resin which forms the layer in which it is contained. When the use amount is too small, it is difficult to obtain the effect as the light/chemical resistant agent whereas the excessively large amount to be used is uneconomical.

In addition to the above light/chemical resistant agent, various additives such as fluorescent brightener and filler can be simultaneously added at an appropriate amount in the adhesive layer.

The thermally transferable protection layer may be provided in phase sequential with the ink layer of the thermal transfer sheet as in the above, or alternatively may be provided alone on a distinct support to make a protection layer transfer sheet.

(Substrate of Image Receiving Sheet)

It is preferable that a substrate (also referred to as a support) of the image receiving sheet has a role to retain the colorant image-receiving layer as well as mechanical strength to an extent that there is no trouble upon handling under a heated condition because the heat is added upon the thermal transfer.

Materials of such a substrate are not particularly limited, and include, for example, condenser paper, glassine paper, parchment paper, or paper with high size degree, synthetic paper (polyolefin type, polystyrene type), quality paper, art paper, coated paper, cast-coated paper, wall paper, paper for lining, synthetic resin or emulsion-impregnated paper, synthetic rubber latex-impregnated paper, synthetic resin inner paper, plate paper, cellulose fiber paper, or films of polyester, polyacrylate, polycarbonate, polyurethane, polyimide, polyetherimide, cellulose derivative, polyethylene, ethylene-vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyethersulfone, tetrafluoroethylene, perfluoroalkylvinylether, polyvinyl fluoride, tetrafluoroethylene-ethylene, tetrafluoroethylene-hexafluoropropylene, polychlorotrifluoroethylene and polyvinylidene fluoride. White opaque films or foamed sheets obtained by adding a white pigment and a filler to these synthetic resins and making into the films or foaming can be used, and they are not particularly limited.

A laminate obtained by optionally combining the above substrates can be also used. Examples of the representative laminate include the laminate of cellulose fiber paper and synthetic paper and the laminate of cellulose synthetic paper and plastic film. The thickness of these supports may be optional, and is typically 10 to 300 μm.

In order to have higher printing sensitivity as well as obtain high image quality with no uneven density and white dropout, it is preferable to make a layer having fine voids (also referred to as a fine void resin layer) exist. As the fine void resin layer, plastic film and synthetic paper having fine voids inside thereof can be used. The fine void resin layer can be formed on various supports by various coating modes. As the plastic film or the synthetic paper having the fine voids, the plastic film or the synthetic paper obtained by using polyolefin, particularly polypropylene as a main body, blending an inorganic pigment and/or a polymer which is incompatible with polypropylene therewith, using these as a void formation initiator, and stretching/making these into film is preferable. When polyester is used as the main body, the printing sensitivity is inferior and the uneven density easily occurs because its cushion property and adiathermancy are inferior due to its visco-elastic and thermal natures compared to those whose main body is polypropylene.

Considering these points, an elastic modulus of the plastic film and the synthetic paper is preferably $5\times10^8$ to $1\times10^{10}$ Pa at 20° C. These plastic film and synthetic paper are typically made as biaxially-oriented films, and thus shrink by heating. When these are left stand for 60 seconds at 110° C., their shrinkage percentage is 0.5 to 2.5%. The aforementioned plastic film and the synthetic paper may be a single layer as such comprising the fine voids or may be a multilayer constitution. In the case of the multilayer constitution, all of the layers may contain the fine voids, or the layer with no fine void may be contained. The white pigment as an opacifying agent may be mixed in the plastic film and the synthetic paper if necessary. In order to also increase white color nature, the additives such as fluorescent brightener may be contained. The thickness of the fine void resin layer is preferably 30 to 80 μm.

As the fine void resin layer, it is possible to form the fine void resin layer on the substrate by a coating method. As the plastic resin used, it is possible to use the publicly known resin such as polyester, urethane resin, polycarbonate, acrylic resin, polyvinyl chloride and polyvinyl acetate alone or by blending two or more.

If necessary, for the purpose of preventing curl, a layer of the resin such as polyvinyl alcohol, polyvinylidene chloride, polyethylene, modified polyolefin, polyethylene terephthalate and polycarbonate or the synthetic paper can be provided on the side of the substrate, opposite to the side on which the colorant image-receiving layer is provided. As a pasting method, publicly known lamination methods such as dry lamination, non-solvent (hot melt) lamination and EC lamination can be used, and the preferable methods are the dry lamination and the non-solvent lamination. An adhesive agent suitable for the non-solvent lamination method includes, for example, TAKENATE 720L supplied from Takeda Pharmaceutical Co., Ltd. An adhesive agent suitable for the dry lamination includes, for example, TAKELAC A969/Takenate A-5 (3/1) supplied from Takeda Pharmaceutical Co., Ltd., and POLYSOL PSA SE-1400 and VINYLOL PSA AV-6200 series supplied from Showa Highpolymer Co., Ltd. The amount of these adhesive agents to be used is in the range of 1 to 8 g/m$^2$, and preferably 2 to 6 g/m$^2$ in terms of the solid content.

When the plastic film and the synthetic paper as described above, or the plastic films one another or the synthetic papers one another, or various papers and the plastic film or the synthetic paper are laminated, they can be pasted together by the adhesive layer.

For the purpose of enhancing adhesive strength between the above substrate and the colorant image-receiving layer (sometimes also referred to as a thermal transfer image-receiving layer and an inkjet image-receiving layer), it is preferable to give various primer treatments and corona discharge treatments onto the substrate surface.

(Image-Receiving Sheet Intermediate Layer)

At least one intermediate layer may be provided between a colorant image layer and the image-receiving sheet substrate. The intermediate layer means all layers provided between the image-receiving layer and the substrate, such as adhesive layer (primer layer), barrier layer, ultraviolet ray absorbing layer, foaming layer and anti-static layer, and any layer known publicly can be used as needed. In order to opacify glaring feeling and unevenness, the addition of the white pigment such as titanium oxide to the intermediate layer allows greater flexibility for substrate selection, and thus it is preferable. A content of the white pigment is preferably 30 to 300 parts by mass in terms of white pigment solid content based on 100 parts by mass of the resin solid content, and more preferably 100 to 300 parts by mass for enhancing opacifying property.

As the intermediate layer, a layer where thermoplastic resin, thermosetting resin or the thermoplastic resin having a functional group is cured by the use of various additives and the other technique can be used. Specifically, the resin obtained by curing polyvinyl alcohol, polyvinyl pyrrolidone, polyester, chlorinated polypropylene, modified polyolefin, urethane resin, acrylic resin, polycarbonate, an ionomer, or a prepolymer having monofunctional and/or multifunctional hydroxyl group with isocyanate and the like can be used.

(Image-Receiving Layer)

A colorant image-receiving layer is composed of the binder resin, various additives such as release agent and a metal ion-containing compound as needed on one side of the substrate. When the metal ion-containing compound is added, the amount thereof to be added is typically preferably 10 to 60%, and more preferably 20 to 50% by mass based on the solid content of the image-receiving layer.

As the binder resin, those known publicly can be used, and it is preferable to use those to which dye is easily dyed. Specifically, polyolefin resin such as polypropylene, halogenated resin such as polyvinyl chloride and polyvinylidene chloride, vinyl type resin such as polyvinyl acetate and polyacrylate ester, polyester type resin such as polyethylene terephthalate and polybutylene terephthalate, polystyrene type resin, polyamide type resin, phenoxy resin, copolymers of olefin such as ethylene and propylene with the other vinyl type monomer, a simple substance or a mixture of polyurethane, polycarbonate, acrylic resin, ionomer and a cellulose derivative can be used alone or in mixture, and among them, the polyester type resin and the vinyl type resin are preferable.

It is preferable to add the release agent into the colorant image-receiving layer in order to prevent thermal fusion with the ink layer. As the release agent, a phosphate ester type plasticizer, a fluorinated compound and silicone oil (including a reaction curable silicone) and the like can be used, and among them, the silicone oil is preferable. As the silicone oil, various modified silicone oils including dimethyl silicone can be used. Specifically, amino modified silicone, epoxy modified silicone, alcohol modified silicone, vinyl modified silicone, urethane modified silicone and the like are used. These can be also used by blending them or polymerizing using various reactions. One or two or more release agents are used. The amount of the release agent to be added is preferably 0.5 to 30 parts by mass based on 100 parts by mass of the resin for forming the image-receiving layer. When the amount to be added does not meet this range, the fusion of the thermal transfer sheet with the image-receiving layer of the image-receiving sheet occurs or photographic printing sensitivity is reduced in some cases. The release agent may be separately provided as the release layer on the image-receiving layer without adding in the image-receiving layer.

(Layer Constitution, Coating Method and the Like)

The above colorant image-receiving layer can be formed by applying a coating solution obtained by dissolving or dispersing in a solvent such as water or organic solvent on the substrate by a usual method such as a bar coater, gravure printing method, screen printing method, roll coating method, reverse roll coating method using photogravure, air knife coating method, spray coating method, curtain coating method and extrusion coating method, and drying. The formation of the barrier layer, the intermediate layer and a backside layer is performed by the same method as in the case of the above image-receiving layer. The image-receiving layer is formed not only by directly applying the coating solution on the substrate and drying, and may be formed but also by transferring and forming onto the substrate from the image-receiving layer previously formed on the other support. The respective layers can be formed by a simultaneous application method of two or more layers, and particularly, the simultaneous application where all of the layers are finished by one application can be performed.

The thickness of the image-receiving layer is preferably 0.1 to 10 μm after applying and drying.

(Shape of Image Receiving Sheet)

The image receiving sheet used in the present invention may be supplied to a printer by sheets or a roll form. A sheet-fed form indicates, for example, a form where the image receiving sheet is cut into a constant size, one set of about 50 sheets is placed in a cassette, which is loaded in the printer to use. The roll form is a form where a roll shape of the image receiving sheet is supplied in the printer and is cut into the desired size after photographic printing to use. In particular, the latter is preferable because feeding trouble such as wrong paper supply such as two sheet feeding and wrong paper discharge is solved and the latter can address high capacity in numbers of printable sheets.

When the image receiving sheet is supplied in the roll form, in particular when the image receiving sheet is a postcard type, or label or seal type, it is possible to provide a detection mark on the backside in order to adjust a cut position to a position of a design mark such as post code or a position of half cut of the seal, formed on the backside.

EXAMPLE

The present invention will be described in detail with reference to the following Examples, but the invention is not limited thereto.

<<Manufacture of Thermal Transfer Sheet>>

[Manufacture of Thermal Transfer Sheet 1]

(Manufacture of Support A with Back Coat Layer)

A support A having a back coat layer with a dried film thickness of 1.0 μm was made by applying a back coat layer coating solution 1 composed of the following composition on one side of polyethylene terephthalate film (LUMIRROR supplied from TORAY Industries, Inc.) with easy-adhering layer with a thickness of 4.5 μm by a gravure coating mode, drying, and subsequently performing a heat curing treatment.

<Preparation of Back Coat Layer Coating Solution 1>

| | |
|---|---|
| Polyvinyl butyral resin (S-Lec BX-1 suppled from Sekisui Chemical Co., Ltd.) | 3.5 parts by mass |
| Phosphate ester type surfactant (PLYSURF A208S supplied from Dai-ichi Kogyo Seiyaku Co., Ltd.) | 3.0 parts by mass |
| Phosphate ester type surfactant (PHOSPHANOL RD720 supplied from Toho Chemical Industry Co., Ltd.) | 0.3 parts by mass |
| Polyisocyanate (BARNOCK D750 Supplied from Dainippon Ink & Chemicals Mfg Co., Ltd.) | 19.0 parts by mass |
| Talc (supplied from Nippon Talc Co., Ltd., Y/X = 0.03) | 0.2 parts by mass |
| Methyl ethyl ketone | 35.0 parts by mass |
| Toluene | 35.0 parts by mass |

[Formation of Colorant (Ink) Layer, Protection Transfer Layer]

A thermal transfer sheet 1 was made by providing an ink layer (dried film thickness: 1 μm) formed using a yellow dye coating solution 1 composed of the following composition in phase sequential with a Multilayer protection transfer layer (three layer constitution of a non-transferable release layer, a protection transfer layer and an adhesive layer) by a gravure method, on the side opposite to the back coat side of the support A with the back coat layer.

[Ink Layer]

<Yellow Dye Coating Solution 1>

| | |
|---|---|
| Colorant (exemplified compound 13) | 4.5 parts by mass |
| Polyvinyl acetoacetal resin (S-Lec KS-5 supplied from Sekisui Chemical Co., Ltd.) | 5.0 parts by mass |
| Urethane modified silicone resin (DIAROMER SP-2105 supplied from Dainichiseika Color & Chemicals Mfg Co., Ltd.) | 0.5 parts by mass |
| Methyl ethyl ketone | 45.0 parts by mass |
| Toluene | 45.0 parts by mass |

[Multilayer Protection Transfer Layer]

(Non-Transferable Release Layer)

A non-transferable release layer was formed by coating and drying a non-transferable release layer coating solution 1 composed of the following composition by a gravure coating method so that a solid content after drying was 0.5 g/m$^2$.

<Non-Transferable Release Layer Coating Solution 1>

| | |
|---|---|
| Colloidal silica (SNOWTEX 50 supplied from Nissan Chemical Industries Ltd.) | 4.0 parts by mass |
| Ion-exchange water | 3.0 parts by mass |
| Modified ethanol | 10 parts by mass |

(Protection Transfer Layer)

A protection transfer layer was formed by coating and drying a protection transfer layer coating solution 1 composed of the following composition on the non-transferable release layer formed above by the gravure coating method so that a solid content after drying was 2.0 g/m$^2$.

<Protection Transfer Layer Coating Solution 1>

| | |
|---|---|
| Acrylic resin | 15 parts by mass |
| Vinyl chloride-vinyl acetate copolymer | 5 parts by mass |
| Copolymer resin reacting and binding a reactive ultraviolet ray absorbing agent (UVA-635L supplied from BASF Japan) | 4 parts by mass |
| Polyethylene wax | 0.3 parts by mass |
| Polyester resin | 0.1 parts by mass |
| Methyl ethyl ketone | 40 parts by mass |
| Toluene | 40 parts by mass |
| Zinc antimonate (CELNAX supplied from Nissan Chemical Industries Ltd.) | 20 parts by mass |

(Adhesive Layer)

An adhesive layer was formed by coating and drying an adhesive layer coating solution 1 composed of the following composition on the protection transfer layer formed above by the gravure coating method so that the solid content after drying was 2.0 g/m$^2$.

<Adhesive Layer Coating Solution 1>

| | |
|---|---|
| Vinyl chloride-vinyl acetate copolymer | 20 parts by mass |
| Methyl ethyl ketone | 100 parts by mass |
| Toluene | 100 parts by mass |

By the above, the Multilayer protection transfer layer detachably comprising the protection transfer layer which is a laminate of the protection transfer layer and the adhesive layer was made on the non-transferable release layer.

[Manufacture of Thermal Transfer Sheets 2 to 7]

The thermal transfer sheets 2 to 7 were made by the same way as in the above manufacture of the thermal transfer sheet 1, except that the yellow dye layer coating solutions 2 to 7 composed of the following compositions were used in place of the yellow dye layer coating solution 1.

(Yellow Dye Layer Coating Solution 2)

The yellow dye layer coating solutions 2 to 7 were prepared by the same way as in the above yellow dye layer coating solution 1, except that the yellow dispersion dyes shown in the following Table 1 were used in place of the colorant (exemplified compound 13).

TABLE 1

| THERMAL TRANSFER SHEET NO. | COATING SOLUTION NO. | COLORANT | OTHERS |
|---|---|---|---|
| THERMAL TRANSFER SHEET 1 | YELLOW LAYER COATING SOLUTION 1 | EXEMPLIFIED COMPOUND 13 | PRESENT INVENTION |
| THERMAL TRANSFER SHEET 2 | YELLOW LAYER COATING SOLUTION 2 | EXEMPLIFIED COMPOUND 3 | PRESENT INVENTION |
| THERMAL TRANSFER SHEET 3 | YELLOW LAYER COATING SOLUTION 3 | EXEMPLIFIED COMPOUND 28 | PRESENT INVENTION |
| THERMAL TRANSFER SHEET 4 | YELLOW LAYER COATING SOLUTION 4 | EXEMPLIFIED COMPOUND 57 | PRESENT INVENTION |
| THERMAL TRANSFER SHEET 5 | YELLOW LAYER COATING SOLUTION 5 | EXEMPLIFIED COMPOUND 97 | PRESENT INVENTION |
| THERMAL TRANSFER SHEET 6 | YELLOW LAYER COATING SOLUTION 6 | EXEMPLIFIED COMPOUND 115 | PRESENT INVENTION |
| THERMAL TRANSFER SHEET 7 | YELLOW LAYER COATING SOLUTION 7 | Y-1 | COMPARATIVE EXAMPLE |

(Y-1)

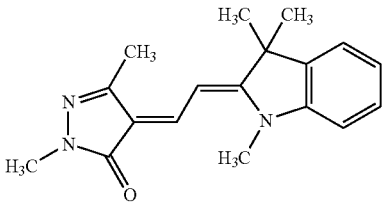

<<Manufacture of Thermal Transfer Image Receiving Sheet>>

[Manufacture of Thermal Transfer Image Receiving Sheet 1]

A thermal transfer image receiving sheet 1 was made in accordance with the followings.

(Manufacture of Support)

Coated paper (basis weight per meter square of 157 g/m$^2$, OK TOP COAT supplied from Oji Paper Co., Ltd.) was used as a support of the image receiving sheet, and a corona discharge treatment was given onto one side thereof. Subsequently, on its backside, as a backside resin layer, high density polyethylene (JEYLEX LZ0139-2, density 0.952 supplied from Nippon Polyolefin Co., Ltd.)(abbreviated as HDPE) to which 15% by mass ethylene-α-olefin copolymer (TOUGHMER A-4085 supplied from Mitsui Petroleum Chemical Ind., Ltd.) had been blended and polypropylene (JEYAROMER LR711-5, density 0.905, supplied from Nippon Polyolefin Co., Ltd.)(abbreviated as PP) were laminated by a co-extrusion coating method in which two layers were co-extruded by multilayer T die known publicly so that the HDPE side was contacted with the coated paper. On the PP side which was an outer side, after giving the corona discharge treatment, a backside layer coating solution 1 composed of the following composition was applied and dried so that a dried solid content was 1.5 g/m$^2$ to make the support B. The backside resin layer was processed so that the thickness of the HDPE layer with ethylene-α-olefin copolymer blend was 14 μm, the thickness of the PP layer was 19 μm and the total thickness was 33 μm.

<Preparation of Backside Layer Coating Solution 1>

| | |
|---|---|
| Acrylic resin (BR-85 supplied from Mitsubishi Rayon Co., Ltd.) | 19.8 parts by mass |

-continued

| | |
|---|---|
| Nylon filler (MW-330 supplied from Shinto Paint Co., Ltd.) | 0.6 parts by mass |
| Methyl ethyl ketone | 39.8 parts by mass |
| Toluene | 39.8 parts by mass |

(Manufacture of Thermal Transfer Image Receiving Sheet)

Meanwhile, as a fine void resin layer, foamed polypropylene sheet with a thickness of 35 μm (35MW846 supplied from Mobil Plastics Europe) was used, and on one side thereof, an intermediate layer coating solution and a coating solution for a colorant (dye) image-receiving layer composed of the following compositions were sequentially applied by a gravure reverse coating method and dried so that each film thickness was 1 μm and 3 μm to make the foamed polypropylene sheet on which the intermediate layer and the dye image-receiving layer were laminated.

Subsequently, the thermal transfer image receiving sheet 1 was made by pasting the surface at the side opposite to the laminate of the intermediate layer and the dye image-receiving layer of the above foamed polypropylene sheet (foamed polypropylene sheet surface) together with the surface at the side opposite to the backside resin layer of the above support B (coated paper surface) using an adhesive agent of the following composition by a dry laminate method.

<Preparation of Intermediate Layer Coating Solution>

| | |
|---|---|
| Urethane type resin (NIPPOLAN 5199 supplied from Nippon Polyurethane Industry Co., Ltd.) | 5.7 parts by mass |
| Titanium oxide (TCA888 supplied from Tochem products Co., Ltd.) | 11.4 parts by mass |
| Fluorescent brightener (UBITEX OB supplied from Nihon Ciba-Geigy K.K.) | 0.2 parts by mass |
| Isocyanate (TAKENATE A-14 supplied from Takeda Pharmaceutical Co., Ltd.) | 2.0 parts by mass |
| Methyl ethyl ketone | 15.5 parts by mass |
| Toluene | 15.5 parts by mass |
| Isopropyl alcohol | 7.7 parts by mass |

<Preparation of Colorant (Dye) Image-Receiving Layer Coating Solution>

| | |
|---|---|
| Vinyl chloride-vinyl acetate copolymer (DENKA VINYL #1000A supplied from Denki Kagaku Kogyo K.K.) | 7.2 parts by mass |
| Vinyl chloride-styrene-acryl copolymer (DENKA LAC #400 supplied from Denki Kagaku Kogyo K.K.) | 1.6 parts by mass |
| Polyester (BYRON supplied from Toyobo Co., Ltd.) | 11.2 parts by mass |
| Metal ion-containing compound (MA-1 *1) | 8.0 parts by mass |
| Vinyl modified silicone (X-62-1212 supplied from Shin-Etsu Chemical Co., Ltd.) | 2.0 parts by mass |
| Catalyst: CAT PLR-5 (supplied from Shin-Etsu Chemical Co., Ltd.) | 1.0 part by mass |
| Catalyst: CAT PL-50T (supplied from Shin-Etsu Chemical Co., Ltd.) | 1.2 part by mass |
| Solvent: methyl ethyl ketone | 39.0 parts by mass |
| Solvent: toluene | 39.0 parts by mass |

*1) MS-1: $Ni^{2+}[C_6H_5OC_4H_8COC(COOC_4H_9)=C(CH_3)O^-]_2$

[Manufacture of Thermal Transfer Image Receiving Sheet 2]

The thermal transfer image receiving sheet 2 was made by the same way in the above manufacture of the thermal transfer image receiving sheet 1, except that a metal ion-containing compound (MS-1) was removed from the above dye image-receiving layer coating solution.

<<Manufacture of Photographic Printing Sample>>

Using the thermal transfer sheets 1 to 7 and the thermal transfer image receiving sheets 1 and 2 made above, photographic printing samples 1 to 8 were made by transferring step patterns at a tone value sequentially increased by 15 tones and subsequently transferring a transparent protection layer onto an image using a sublimatic thermal printer (RC-602 type supplied from Konica Minolta Photo Imaging Inc.).

Sensitivity of a thermal transfer recording material, light resistance of an image and color reproducibility in the resulting image sample were evaluated in accordance with the followings.

<<Evaluation of Sensitivity>>

When applied energy was made 1.0 when an image density of the photographic printing sample 8 (Comparative Example) was 1.0, relative applied energy of each sample was obtained. The smaller numeral indicates the higher sensitivity. The results are shown in Table 2.

<<Light Resistance>>

The light resistance was evaluated by irradiating light to the resulting image for 5 days using a xenon fade meter.

The results of residual compound percentage after light irradiation are shown in Table 2.

The residual compound percentage is represented by $D/D_0 \times 100$ when the densities before and after the light irradiation are $D_0$ and D, respectively.

<<Color Reproducibility>>

Color tone of the resulting image was visually evaluated. Ten monitors evaluated visually on a scale of A to C;

A: bright color

B: dim color

C: dirty color.

The results are shown in Table 2.

TABLE 2

| PHOTOGRAPHIC PRINTING SAMPLE NO. | TRANSFER SHEET | IMAGE RECEIVING SHEET | SENSITIVITY | LIGHT RESISTANCE | COLOR REPRODUCIBILITY | OTHERS |
|---|---|---|---|---|---|---|
| PHOTOGRAPHIC PRINTING SAMPLE 1 | 1 | 1 | 0.73 | 97 | A | PRESENT INVENTION |
| PHOTOGRAPHIC PRINTING SAMPLE 2 | 2 | 1 | 0.86 | 86 | A | PRESENT INVENTION |
| PHOTOGRAPHIC PRINTING SAMPLE 3 | 2 | 2 | 0.85 | 81 | A | PRESENT INVENTION |
| PHOTOGRAPHIC PRINTING SAMPLE 4 | 3 | 2 | 0.84 | 79 | A | PRESENT INVENTION |
| PHOTOGRAPHIC PRINTING SAMPLE 5 | 4 | 2 | 0.79 | 85 | A | PRESENT INVENTION |
| PHOTOGRAPHIC PRINTING SAMPLE 6 | 5 | 2 | 0.76 | 89 | A | PRESENT INVENTION |
| PHOTOGRAPHIC PRINTING SAMPLE 7 | 6 | 2 | 0.92 | 75 | A | PRESENT INVENTION |
| PHOTOGRAPHIC PRINTING SAMPLE 8 | 7 | 2 | 1.00 | 27 | B | COMPARATIVE EXAMPLE |

As shown in Table 2, by the use of the thermal transfer recording material using the compound of the present invention, it is possible to obtain the image with high sensitivity, which is excellent in image storage stability (light resistance) and color reproducibility.

The entire disclosure of Japanese Patent Application No. 2004-197518 filed on Jul. 5, 2004, including specification, claims, drawings and summary are incorporated herein by reference.

What is claimed is:

1. A thermal transfer recording material comprising at least one colorant represented by the following general formula (I):

General formula (I)
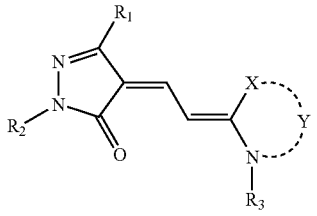
wherein $R_1$ represents —$COOC_2H_5$;
$R_2$ represents methyl, propyl, butyl, iso-propyl, tert-butyl;
$R_3$ represents methyl, ethyl, propyl or iso-propyl; and
X and Y respectively represent —$CH_2$— and —$CH_2CH_2$— to form together an indole ring.
* * * * *

UNITED STATES PATENT AND TRADEMARK OFFICE

CERTIFICATE OF CORRECTION

PATENT NO. : 7,553,797 B2
APPLICATION NO. : 11/172712
DATED : June 30, 2009
INVENTOR(S) : Kaori Ono et al.

It is certified that error appears in the above-identified patent and that said Letters Patent is hereby corrected as shown below:

Item (73) on the Title Pg, "Konica Minolta Photo Imaging, Inc." should read
--DAI NIPPON PRINTING CO., LTD.--

Signed and Sealed this

Twenty-first Day of September, 2010

David J. Kappos

David J. Kappos
*Director of the United States Patent and Trademark Office*